US009233781B2

(12) United States Patent
Izu et al.

(10) Patent No.: US 9,233,781 B2
(45) Date of Patent: Jan. 12, 2016

(54) CARTRIDGE RECEIVING CASE

(71) Applicant: Sony Corporation, Tokyo (JP)

(72) Inventors: Rie Izu, Miyagi (JP); Shuichi Kikuchi, Miyagi (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/074,184

(22) Filed: Nov. 7, 2013

(65) Prior Publication Data

US 2014/0131375 A1 May 15, 2014

(30) Foreign Application Priority Data

Nov. 14, 2012 (JP) ..... 2012-250101

(51) Int. Cl.
*B65D 51/04* (2006.01)
*B65D 43/16* (2006.01)
*B65D 43/22* (2006.01)

(52) U.S. Cl.
CPC ..... *B65D 43/162* (2013.01); *B65D 43/22* (2013.01)

(58) Field of Classification Search
CPC ..... B65D 43/162; B65D 43/22
USPC ..... 220/836; 206/307, 308.1, 308.3, 309, 206/312, 459.5
See application file for complete search history.

(56) References Cited

U.S. PATENT DOCUMENTS

| | | | | |
|---|---|---|---|---|
| 5,200,938 | A * | 4/1993 | Akiyama et al. | 369/30.83 |
| 5,772,028 | A * | 6/1998 | Marsilio et al. | 206/387.1 |
| 5,931,296 | A * | 8/1999 | Kobayashi et al. | 206/308.3 |
| 7,841,487 | B2 * | 11/2010 | Miller et al. | 220/826 |
| 2006/0243625 | A1 * | 11/2006 | Biddick et al. | 206/459.5 |
| 2009/0084801 | A1 * | 4/2009 | Coe | 220/740 |

FOREIGN PATENT DOCUMENTS

JP 2000-238882 A 9/2000

* cited by examiner

*Primary Examiner* — Anthony Stashick
*Assistant Examiner* — James M Van Buskirk
(74) *Attorney, Agent, or Firm* — Hazuki International, LLC

(57) ABSTRACT

Provided is a cartridge receiving case including a case section in which a cartridge is inserted and disposed, a lid section configured to be opened and closed with respect to the case section and to cover the cartridge disposed in the case section upon closing, and a rear plate section configured to connect the case section and the lid section. The case section, the lid section, and the rear plate section are integrally formed. A pair of parallel thin hinges are formed as curved portions when the lid section is opened and closed with respect to the case section. One of the thin hinges is formed at a position deviated with respect to a continuous portion between the rear plate section and the case section. The other thin hinge is formed at a position deviated with respect to a continuous portion between the rear plate section and the lid section.

10 Claims, 21 Drawing Sheets

CARTRIDGE RECEIVING CASE

CROSS REFERENCE TO RELATED APPLICATIONS

This application claims the benefit of Japanese Priority Patent Application JP 2012-250101 filed Nov. 14, 2012, the entire contents of which are incorporated herein by reference.

BACKGROUND

The present technology relates to a technical field of a cartridge receiving case, and more particularly, to a technical field of a cartridge receiving case, in which a cartridge is received, having a pair of thin hinges pivoted as a fulcrum to perform opening and closing operations.

For example, a plurality of disk-shaped recording media are configured to be received in a cartridge in parallel in an axial direction of a central shaft. Such a cartridge is used in, for example, a disk reproducing apparatus for reproducing music, in which a desired disk-shaped recording medium is extracted by an extraction mechanism to reproduce music data recorded on the disk-shaped recording medium.

In addition, in recent times, a recording capacity of the disk-shaped recording medium has remarkably increased, and necessity of the cartridge used in a data center or the like, in which the plurality of disk-shaped recording media having a large recording capacity are configured to be received in parallel in the axial direction of the central shaft, has also increased.

The above-mentioned cartridge is accommodated and held in, for example, a cartridge receiving case.

Such a cartridge receiving case has a case section in which a cartridge is inserted and disposed, a lid section configured to be opened and closed with respect to the case section and configured to cover the cartridge disposed in the case section upon closing, and a rear plate section configured to connect the case section and the lid section, which are integrally formed with each other (for example, see Japanese Patent Application Laid-open No. 2000-238882).

In the cartridge receiving case disclosed in Japanese Patent Application Laid-open No. 2000-238882, the case section (a case main body) and the lid section (a lid body) are connected to the rear plate section (a rear plate piece) via a pair of thin hinges (hinge sections), the rear plate section is pivotable with respect to the case section via one thin hinge, and the lid section is pivotable with respect to the rear plate section via the other thin hinge.

In the cartridge receiving case, in a state in which the cartridge is inserted and disposed in the case section, as the rear plate section is pivoted with respect to the case section to pivot the lid section with respect to the rear plate section to cover the cartridge by the lid section, the cartridge can be received therein.

SUMMARY

However, in the cartridge receiving case disclosed in Japanese Patent Application Laid-open No. 2000-238882, the one thin hinge is installed at a continuous portion (a ridgeline) between the case section and the rear plate section, the other thin hinge is installed at a continuous portion (a ridgeline) between the lid section and the rear plate section, and the respective thin hinges are disposed at corners.

Accordingly, the thin hinge installed at the corner may easily collide with a droppage surface when the cartridge receiving case is dropped, and a large shock may be applied to the thin hinge to easily generate damage or rupture on the thin hinge, decreasing shock resistance.

Here, it is desirable to provide the cartridge receiving case that suppresses generation of the damage or the rupture on the thin hinge to improve the shock resistance.

Firstly, according to an embodiment of the present disclosure, there is provided a cartridge receiving case including a case section in which a cartridge is inserted and disposed, a lid section configured to be opened and closed with respect to the case section and to cover the cartridge disposed in the case section upon closing, and a rear plate section configured to connect the case section and the lid section. The case section, the lid section, and the rear plate section are integrally formed, a pair of parallel thin hinges are formed as curved portions when the lid section is opened and closed with respect to the case section, one of the thin hinges is formed at a position deviated with respect to a continuous portion between the rear plate section and the case section, and the other thin hinge is formed at a position deviated with respect to a continuous portion between the rear plate section and the lid section.

Accordingly, in the cartridge receiving case, it is difficult for the thin hinge to collide with the droppage surface upon droppage.

Secondly, as for the cartridge receiving case described above, it is preferable that the pair of thin hinges are formed at the rear plate section.

As the pair of thin hinges are formed at the rear plate section, the thin hinge does not come in contact with the placing surface.

Thirdly, as for the cartridge receiving case described above, it is preferable that reinforcement protrusions protruding outward are formed at both end sections of an outer surface of the rear plate section in directions in which the pair of thin hinges extend.

The reinforcement protrusions protruding outward may be formed at both end sections of the outer surface of the rear plate section in the direction in which the pair of thin hinges extend.

As the reinforcement protrusions protruding outward may be formed at both end sections of the outer surface of the rear plate section in the direction in which the pair of thin hinges extend, it is difficult for the thin hinges to collide with the droppage surface.

Fourthly, as for the cartridge receiving case described above, it is preferable that cutout sections disposed on the extension lines of the thin hinges are formed at both end sections of the rear plate section in directions in which the pair of thin hinges extend.

As the cutout sections disposed on extension lines of the thin hinges are formed at both end sections of the rear plate section in the direction in which the pair of thin hinges extend, even when both ends of the rear plate section collide with the droppage surface, the thin hinges do not collide with the droppage surface.

Fifthly, as for the cartridge receiving case described above, it is preferable that a base plate section, a standing wall section protruding from at least a portion around an outer circumference of the base plate section, and a rib section protruding from a portion of an outer circumferential section of the base plate section in a same direction as the standing wall section are formed at the case section; a closed surface section disposed opposite to the base plate section upon the closing and an enclosing wall section protruding from at least a portion of an outer circumferential section of the closed surface section are formed at the lid section; and the enclosing wall section is fitted between the standing wall section and the rib section upon the closing.

As the enclosing wall section is fitted between the standing wall section and the rib section upon the closing, stiffness of the cartridge receiving case is increased.

Sixthly, as for the cartridge receiving case described above, it is preferable that a lock piece section having an engaging protrusion or an engaging concave section is formed at one of the case section and the lid section, and an engaging concave section or an engaging protrusion with which the engaging protrusion or the engaging concave section is engaged upon the closing may be formed at the other of the case section and the lid section.

As the lock piece section having the engaging protrusion or the engaging concave section is installed at one of the case section and the lid section, and the engaging concave section or the engaging protrusion with which the engaging protrusion or the engaging concave section is engaged is installed at the other of the case section and the lid section, the lid section is locked to the case section by the lock piece section.

Seventhly, as for the cartridge receiving case described above, it is preferable that an elastic deformation section configured to press the cartridge in an elastically deformed state is formed at the case section.

As the elastic deformation section configured to press the cartridge in an elastically deformed state is installed at the case section, the elastic deformation section is elastically deformed to be pressed against the case body.

Eighthly, as for the cartridge receiving case described above, it is preferable that at least three elastic deformation sections are formed, and surfaces of an outer circumferential surface of the cartridge in different directions are configured to be pressed by the respective elastic deformation sections.

As the at least three elastic deformation sections are installed and the surface of the cartridge directed in a direction different from the outer circumferential surface is pressed by each of the elastic deformation sections, the at least three elastic deformation sections are elastically deformed to be pressed against the case body.

Ninthly, as for the cartridge receiving case described above, it is preferable that a base plate section, a standing wall section protruding from at least a portion around an outer circumference of the base plate section, and a pressing surface section connected to the standing wall section and opposite to the base plate section are formed at the case section, and the cartridge is configured to be pressed toward the base plate section by the pressing surface section.

As the standing wall section protruding from at least the portion of the outer circumference of the base plate section and base plate section and the pressing surface section connected to the standing wall section and opposite to the base plate section are installed at the case section and the cartridge is pressed toward the base plate section by the pressing surface section, the cartridge is disposed in the case section in a stable state.

Tenthly, as for the cartridge receiving case described above, it is preferable that a base plate section is formed at the case section, a closed surface section disposed opposite to the base plate section upon the closing is formed at the lid section, and a pressing protrusion configured to press the cartridge upon the closing is formed at the closed surface section.

As the base plate section is installed at the case section, the closed surface section disposed opposite to the base plate section upon the closing is installed at the lid section, and the pressing protrusion configured to press the cartridge upon the closing is installed at the closed surface section, the cartridge is disposed in the case section in a stable state.

The cartridge receiving case according to an embodiment of the present technology includes a case section in which a cartridge is inserted and disposed, a lid section configured to be opened and closed with respect to the case section and to cover the cartridge disposed in the case section upon closing, and a rear plate section configured to connect the case section and the lid section. The case section, the lid section, and the rear plate section are integrally formed, a pair of parallel thin hinges are formed as curved portions when the lid section is opened and closed with respect to the case section, one of the thin hinges is formed at a position deviated with respect to a continuous portion between the rear plate section and the case section, and the other thin hinge is formed at a position deviated with respect to a continuous portion between the rear plate section and the lid section.

Accordingly, since it is difficult for the thin hinge to collide with the droppage surface and it is difficult to apply the shock to the thin hinge, it is difficult to generate the damage or the rupture on the thin hinge and the shock resistance can be improved.

According to an embodiment of the present technology, the pair of thin hinges may be formed at the rear plate section.

Accordingly, the thin hinge does not come in contact with the placing surface, the shock is unlikely to be applied to the thin hinge to that extent, the damage or the rupture on the thin hinge is unlikely to be generated, and in particular, the shock resistance can be improved.

According to an embodiment of the present technology, reinforcement protrusions protruding outward may be formed at both end sections of an outer surface of the rear plate section in directions in which the pair of thin hinges extend.

Accordingly, it is difficult for the thin hinge to collide with the droppage surface, and generation of the damage or the rupture on the thin hinge can be suppressed.

According to an embodiment of the present technology, cutout sections disposed on the extension lines of the thin hinges may be formed at both end sections of the rear plate section in directions in which the pair of thin hinges extend.

Accordingly, even when both ends of the rear plate section collide with the droppage surface upon droppage of the cartridge receiving case, the thin hinge does not collide with the droppage surface, and generation of the damage or the rupture on the thin hinge can be suppressed.

According to an embodiment of the present technology, a base plate section, a standing wall section protruding from at least a portion around an outer circumference of the base plate section and a rib section protruding from a portion of an outer circumferential section of the base plate section in a same direction as the standing wall section may be formed at the case section, a closed surface section disposed opposite to the base plate section upon the closing and an enclosing wall section protruding from at least a portion of an outer circumferential section of the closed surface section may be formed at the lid section, and the enclosing wall section may be fitted between the standing wall section and the rib section upon the closing.

Accordingly, since the appropriate closed state of the lid section with respect to the case section is secured and the enclosing wall section of the lid section comes in contact with the standing wall section of the case section in the thickness direction, stiffness of the cartridge receiving case can be increased, and deformation due to the shock when the shock is applied to the cartridge receiving case can be suppressed to improve the shock resistance.

According to an embodiment of the present technology, a lock piece section having an engaging protrusion or an engaging concave section may be formed at one of the case section and the lid section, and an engaging concave section or an engaging protrusion with which the engaging protrusion or the engaging concave section is engaged upon the closing may be formed at the other of the case section and the lid section.

Accordingly, since the lid section is locked to the case section by the lock piece section, the lid section is not easily opened by a shock from dropping or the like, and the shock resistance of the cartridge receiving case can be improved.

According to an embodiment of the present technology, an elastic deformation section configured to press the cartridge in an elastically deformed state may be formed at the case section.

Accordingly, the cartridge can be disposed in the case section in a stable state without shaking, displacement of the cartridge in the cartridge receiving case is suppressed, the vibrations or shocks are unlikely to be applied to the case section from the cartridge, and the damage or destruction to the cartridge receiving case can be prevented.

According to an embodiment of the present technology, at least three elastic deformation sections may be formed, and surfaces of an outer circumferential surface of the cartridge in different directions may be configured to be pressed by the respective elastic deformation sections.

Accordingly, displacement of the cartridge in the cartridge receiving case can be suppressed, the vibration or shock is unlikely to be applied to the case section from the cartridge, and the damage or destruction to the cartridge receiving case can be prevented.

According to an embodiment of the present technology, a base plate section, a standing wall section protruding from at least a portion around an outer circumference of the base plate section, and a pressing surface section connected to the standing wall section and opposite to the base plate section may be formed at the case section, and the cartridge may be configured to be pressed toward the base plate section by the pressing surface section.

Accordingly, the cartridge can be disposed in the case section in a stable state, displacement of the cartridge in the cartridge receiving case can be suppressed, and the damage or destruction to the cartridge receiving case can be prevented.

According to an embodiment of the present technology, a base plate section may be formed at the case section, a closed surface section disposed opposite to the base plate section upon the closing may be formed at the lid section, and a pressing protrusion configured to press the cartridge upon the closing may be formed at the closed surface section.

Accordingly, the cartridge can be disposed in the case section in a stable state, displacement of the cartridge in the cartridge receiving case can be suppressed, and the damage or destruction to the cartridge receiving case can be prevented.

DETAILED DESCRIPTION OF THE EMBODIMENT

Figure 1:
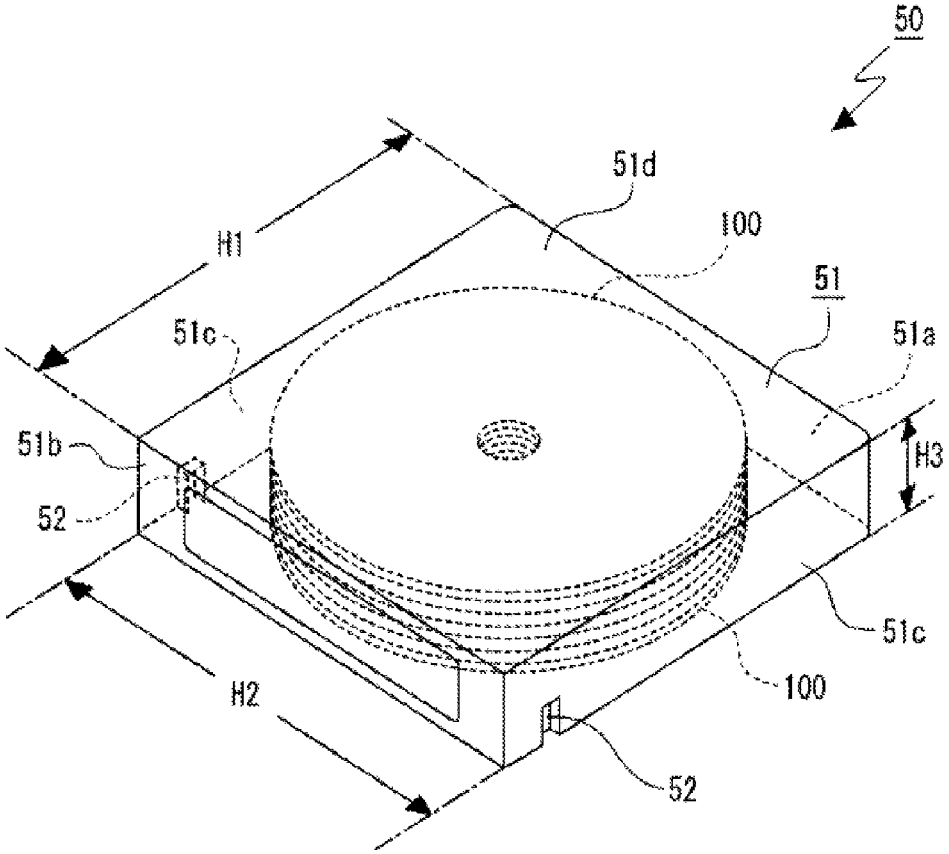
FIG. 1 is a perspective view of a cartridge received in a cartridge receiving case of the present technology, showing an embodiment of the cartridge receiving case with FIGS. 2 to 21.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

In addition, while the cartridge receiving case has a case section in which a cartridge is inserted and disposed and a lid section opened and closed with respect to the case section, in the following description, a direction in a state in which the lid section is opened and the case section is disposed on a placing surface of a desk or the like is shown. In a state in which the lid section is open, a direction in which the lid section and the case section are in parallel is referred to as leftward and rightward directions, and a direction in which the cartridge is inserted and discharged with respect to the case section is referred to as forward and rearward directions.

Further, the following forward, rearward, upward, downward, leftward and rightward directions are described for the purpose of convenience, and the description of the present technology is not limited to these directions.

[Configuration of Cartridge]

First, a configuration of a cartridge 50 received in the cartridge receiving case will be described (see FIG. 1).

The cartridge 50 is constituted by disposing necessary parts in a case body 51. A plurality of disk-shaped recording media 100, 100 . . . are able to be received in the case body 51 in upward and downward directions at equal intervals.

The case body 51 is formed in a substantially rectangular parallelepiped shape, a width H1 in the forward and rearward directions is slightly larger than a width H2 in the leftward and rightward directions, and a width (a thickness) H3 in the upward and downward directions is smaller than the width H1 and the width H2. Grip sections 52 and 52 opened downward and sideward (outward) are formed at positions of rear ends of the case body 51.

While the cartridge 50 is mounted on a recording and reproducing apparatus (not shown), the grip sections 52 and 52 are gripped by an arm of the recording and reproducing apparatus when mounted on the recording and reproducing apparatus to be conveyed and held at a predetermined position. When the cartridge 50 is mounted on the recording and reproducing apparatus, the disk-shaped recording medium 100 received in the case body 51, which is open, is extracted by the extraction mechanism, and recording and reproduction of the information signal with respect to the extracted disk-shaped recording medium 100 are performed.

[Configuration of Cartridge Receiving Case]

Next, a configuration of the cartridge receiving case 1 will be described (see FIGS. 2 to 9).

Figure 2:
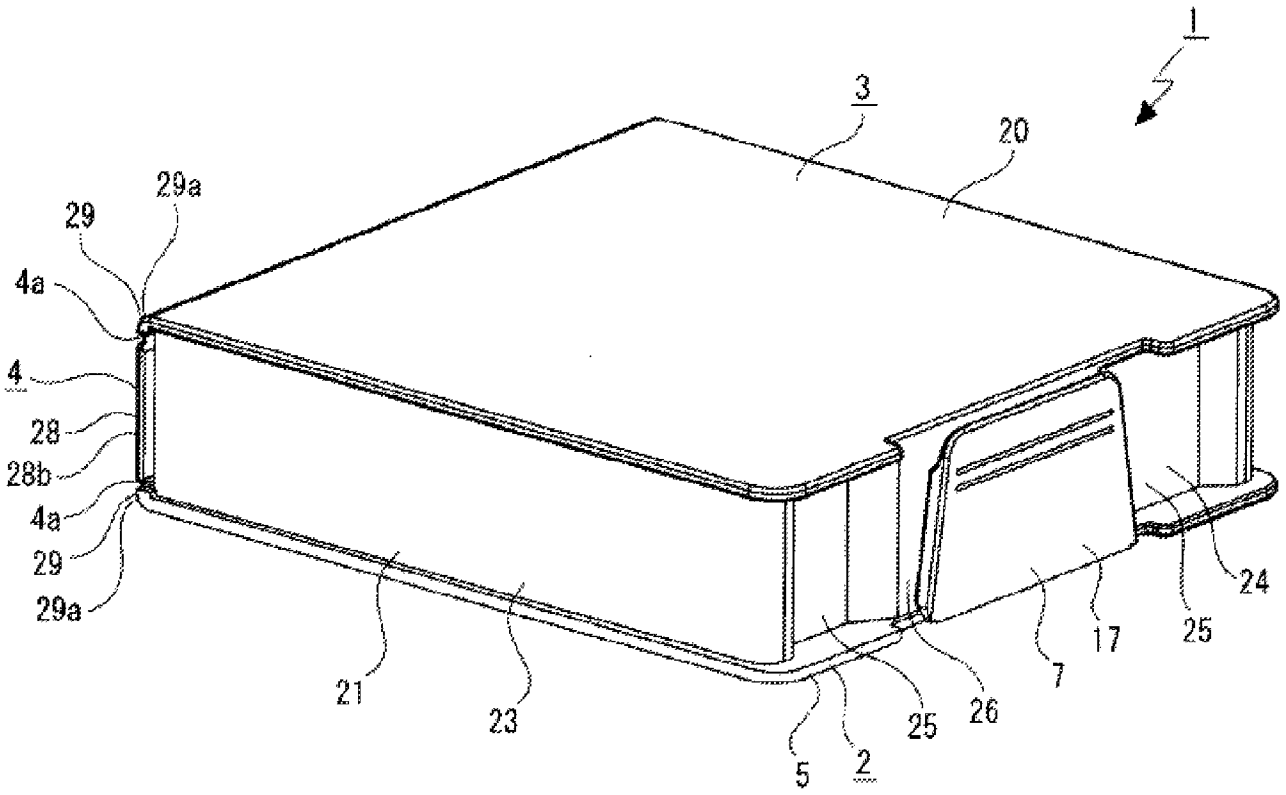
FIG. 2 is a perspective view of the cartridge receiving case.
Figure 3:
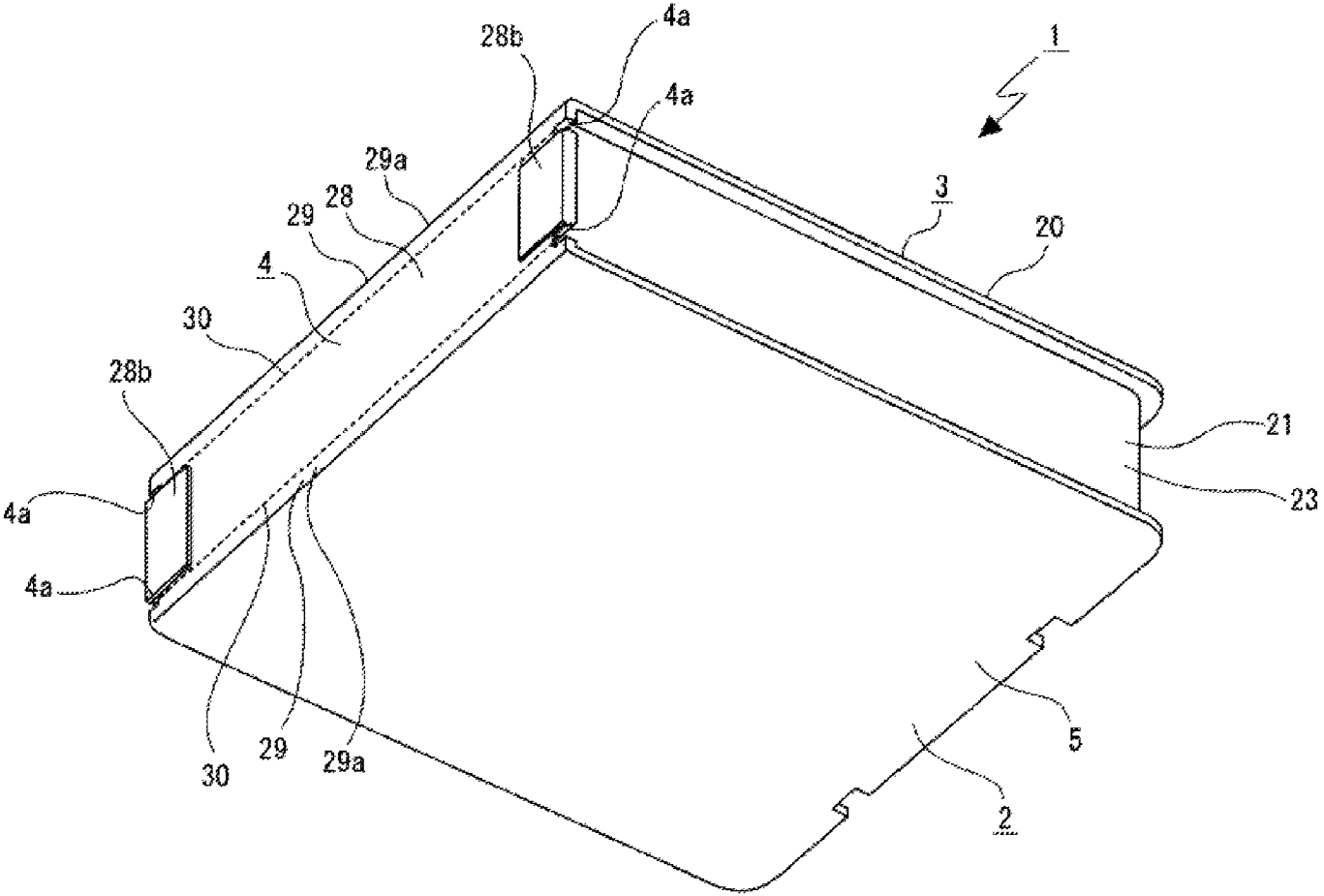
FIG. 3 is a perspective view of the cartridge receiving case when seen in a different direction from FIG. 2.
Figure 4:
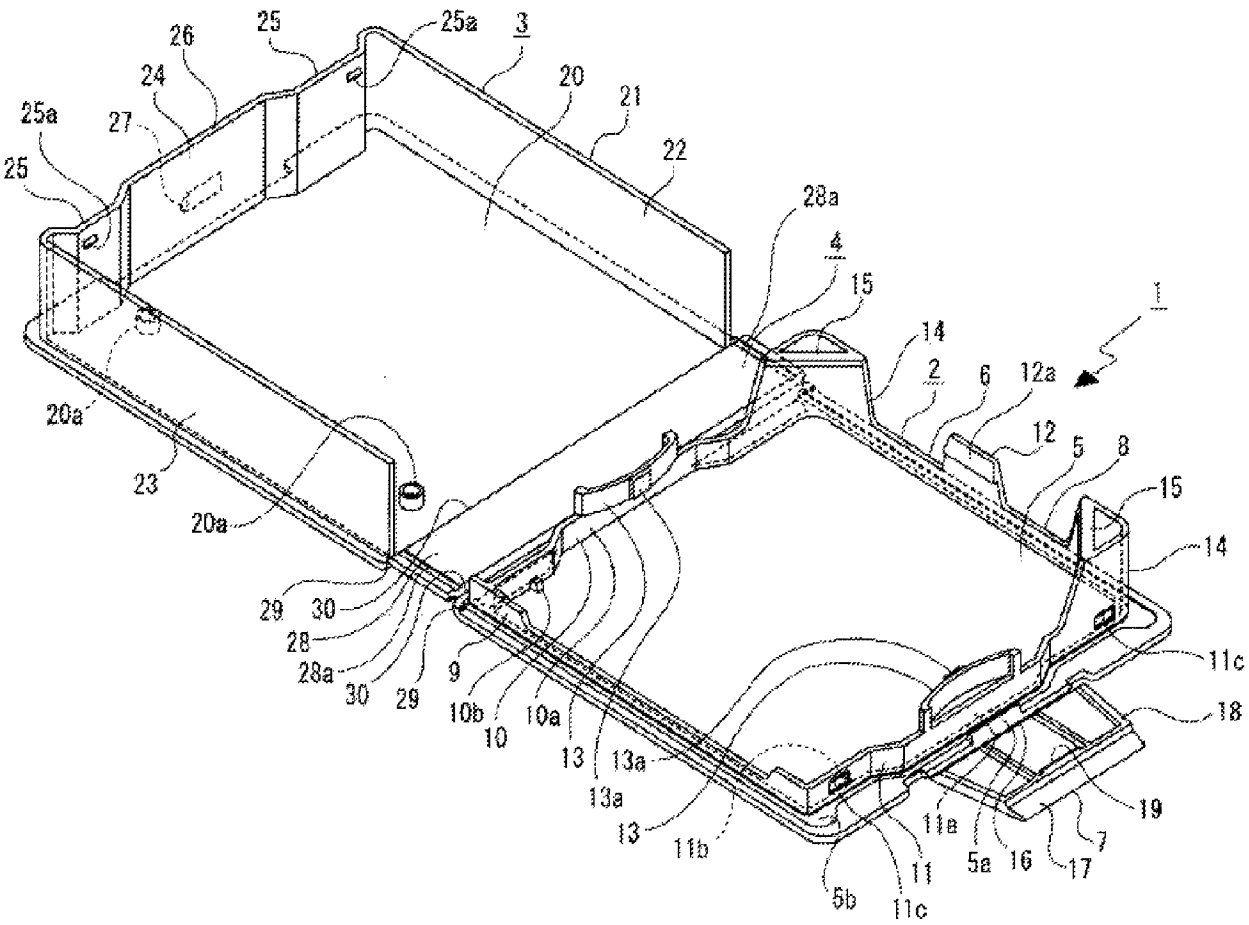
FIG. 4 is a perspective view showing an open state of the cartridge receiving case.

A cartridge receiving case 1 is constituted by integrally forming a case section 2, a lid section 3 and a rear plate section 4, which are formed of a resin material (see FIGS. 2 to 4). For example, a transparent resin material such as polypropylene, polyethylene, or the like, may be used as a material of the cartridge receiving case 1. As the cartridge receiving case 1 is formed of a transparent material, in a state in which the cartridge 50 is received in the cartridge receiving case 1, a state of the cartridge 50, a label attached to the cartridge 50, or the like, can be visually confirmed from the outside of the cartridge receiving case 1.

In addition, an opaque material or a combination of the transparent material and the opaque material may be used as a material of the cartridge receiving case 1, and only a portion corresponding to the label or the like attached to the cartridge 50 can be formed of a transparent material.

Further, when a translucent material is used as a material of the cartridge receiving case 1, only the portion corresponding to the label or the like attached to the cartridge 50 can be reduced in thickness to increase visual confirmation of the label or the like from the outside.

In the cartridge receiving case 1, the lid section 3 and the case section 2 in the closed state are coupled in a vertically overlapping state (see FIGS. 2 and 3), and the lid section 3 and the case section 2 in the open state are laterally disposed in parallel (see FIG. 4).

The case section 2 has a base plate section 5 formed in a substantially rectangular shape in the upward and downward directions, a standing wall section 6 protruding upward from a portion around an outer circumference of an upper surface of the base plate section 5, and a lock piece section 7 protruding rightward from a right side edge of the base plate section 5.

A rib section 5*a* protruding upward is formed at a right end section of the upper surface of the base plate section 5, and the rib section 5*a* is installed at a central section in the forward and rearward directions. A shallow insertion concave section 5*b* opened upward is formed in the outer circumferential section of the base plate section 5. The insertion concave section 5*b* is formed at the outer circumferential side of the standing wall section 6, and a portion thereof is disposed between the standing wall section 6 and the rib section 5*a*.

Figure 5:
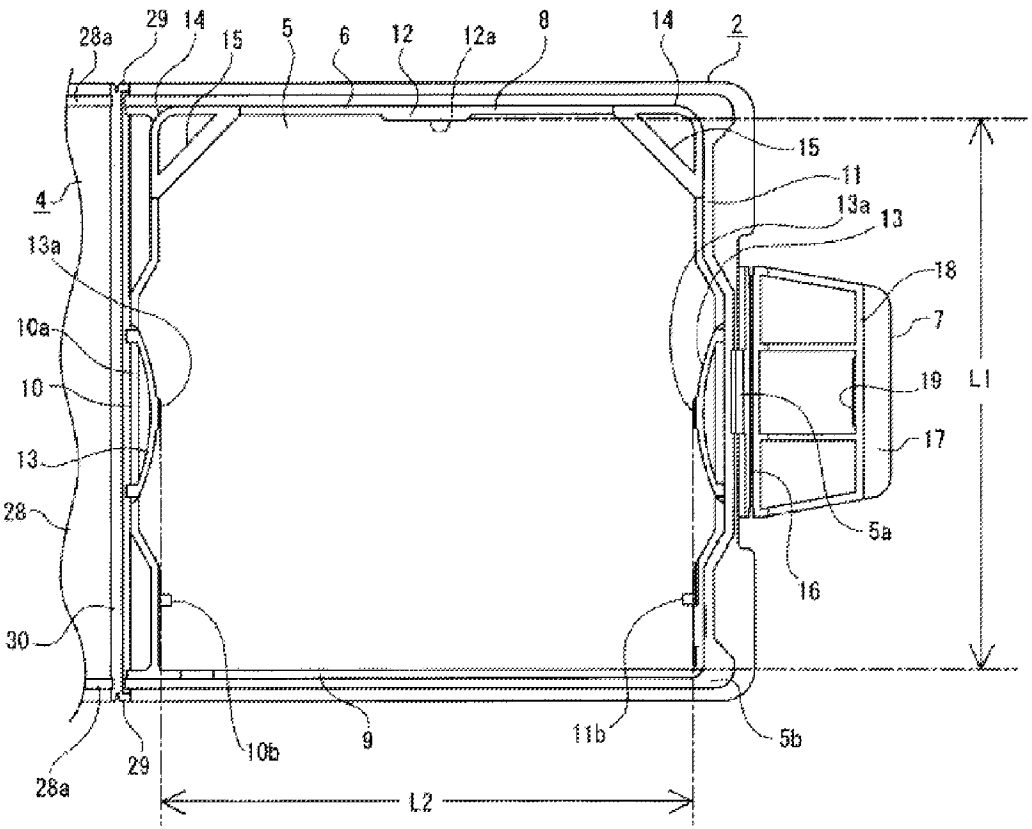
FIG. 5 is a plan view of a case section.
Figure 6:
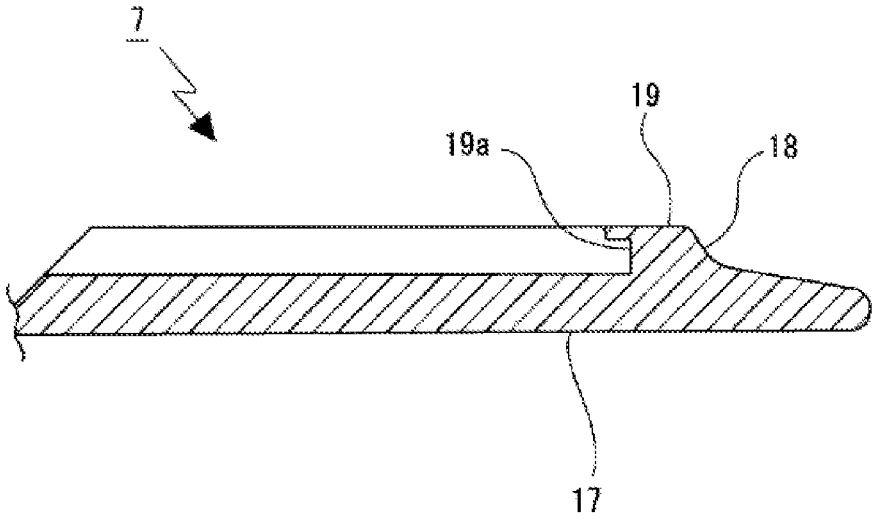
FIG. 6 is an enlarged cross-sectional view showing a lock piece section.
Figure 7:
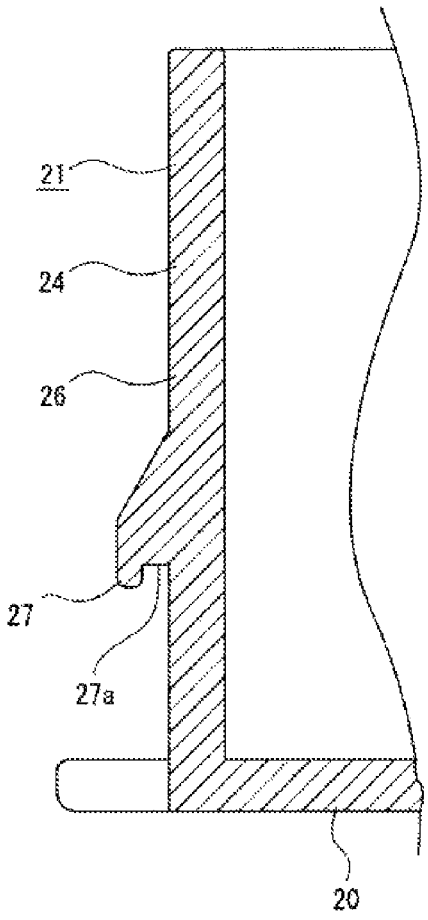
FIG. 7 is an enlarged cross-sectional view mainly showing a side surface section of a lid section.

The standing wall section 6 is formed in a frame shape by a front sidewall section 8, a rear sidewall section 9, a left sidewall section 10 and a right sidewall section 11 (see FIGS. 4 and 5).

A first elastic deformation section 12 protruding substantially upward is formed at a central section in the leftward and rightward directions of the front sidewall section 8. The first elastic deformation section 12 is slightly inclined rearward, and has a receiving section 12*a* of a convex portion disposed in the rear of the upper end section. The first elastic deformation section 12 is elastically deformable such that the receiving section 12*a* is displaced in the forward and rearward directions. A distance L1 between the receiving section 12*a* and the rear sidewall section 9 of the first elastic deformation section 12 is slightly smaller than the width H1 (see FIG. 1) in the forward and rearward directions of the case body 51 of the cartridge 50.

The left sidewall section 10 and the right sidewall section 11 have central sections in the forward and rearward directions formed as swelling sections 10*a* and 11*a*, respectively, disposed outside farther than the other portions (see FIGS. 4 and 5). Misinsertion prevention protrusions 10*b* and 11*b* are formed at positions around rear ends of the left sidewall section 10 and the right sidewall section 11, respectively. The misinsertion prevention protrusions 10*b* and 11*b* protrude in a direction approaching each other to be disposed at lower end sides of the left sidewall section 10 and the right sidewall section 11, respectively.

Locking concave sections 11*c* and 11*c* opened rightward are formed at positions around both front and rear ends of the right sidewall section 11.

Second elastic deformation sections 13 and 13 are formed at upper sides of the left sidewall section 10 and the right sidewall section 11. The second elastic deformation sections 13 and 13 extend in substantially the forward and rearward directions to be formed in a gentle arc shape of a convex portion in a direction approaching each other, and both front and rear end sections are connected to the swelling sections 10*a* and 11*a* of the left sidewall section 10 and the right sidewall section 11, respectively. Receiving sections 13*a* and 13*a* of the convex portion are formed at central sections in the forward and rearward directions of the second elastic deformation sections 13 and 13 in a direction approaching each other. The second elastic deformation sections 13 and 13 are elastically deformable such that the receiving sections 13*a* and 13*a* are displaced in the leftward and rightward directions.

A distance L2 between the receiving sections 13*a* and 13*a* of the second elastic deformation sections 13 and 13 is slightly smaller than the width H2 (see FIG. 1) in the leftward and rightward directions of the case body 51 of the cartridge 50.

Upright sections 14 and 14 protruding upward are formed at left and right corners disposed at a front side of the standing wall section 6 (see FIGS. 4 and 5). The upright sections 14 and 14 are formed at a portion extending from a left end section of the front sidewall section 8 to a front end section of the left sidewall section 10 and a portion extending from a right end section of the front sidewall section 8 to a front end section of the right sidewall section 11.

Pressing surface sections 15 and 15 are formed at upper sides of the upright sections 14 and 14. The pressing surface section 15 is installed to cross over both end sections of the upper end section of the upright section 14.

The lock piece section 7 protrudes rightward from a central section in the forward and rearward directions of the right side edge of the base plate section 5. The lock piece section 7 is connected to the base plate section 5 by a hinge section 16 extending forward and rearward, and is pivotable with respect to the base plate section 5 using the hinge section 16 as a fulcrum. The hinge section 16 is a thin hinge.

The lock piece section 7 has a base surface section 17 having a flat plate shape, and a reinforcement rib 18 formed at one surface of the base surface section 17, i.e., a surface directed upward upon opening of the cartridge receiving case 1. An engaging protrusion 19 is formed at one surface of the base surface section 17 of the lock piece section 7 to be continuous to a portion of the reinforcement rib 18. The engaging protrusion 19 is formed to extend forward and rearward. A concave section opened toward one side is formed between the engaging protrusion 19 and the base surface section 17, and the concave section is formed as an engaging concave section 19*a* (see FIG. 6).

The lid section 3 has a closed surface section 20 directed in the upward and downward directions and an enclosing wall section 21 protruding upward from a portion around the outer circumference of the closed surface section 20 (see FIG. 4).

Pressing protrusions 20*a* and 20*a* spaced leftward and rightward from each other are formed at an inner surface of the closed surface section 20, i.e., an upper surface in a state in which the lid section 3 is opened. The pressing protrusions 20*a* and 20*a* are formed at positions around rear ends of the closed surface section 20.

The enclosing wall section 21 is constituted by a front surface section 22, a rear surface section 23 and a side surface section 24 to form substantially a "C" shape. The side surface section 24 protrudes from a portion around an end section of the closed surface section 20 opposite to the rear plate section 4.

The side surface section 24 is formed as concave shaped sections 25 and 25 having both of front and rear side portions disposed inside more than the other portion, and a portion between the concave shaped sections 25 and 25 is formed as a protrusion shaped section 26 disposed further outside than the concave shaped sections 25 and 25. Locking protrusions 25*a* and 25*a* are formed at inner surfaces of the concave shaped sections 25 and 25. An engaging protrusion 27 is formed at an outer surface of the protrusion shaped section 26. The engaging protrusion 27 is formed to extend forward and rearward. A concave section opened toward one side is formed between the engaging protrusion 27 and the protrusion shaped section 26, and the concave section is formed as an engaging concave section 27*a* (see FIG. 7).

Figure 8:
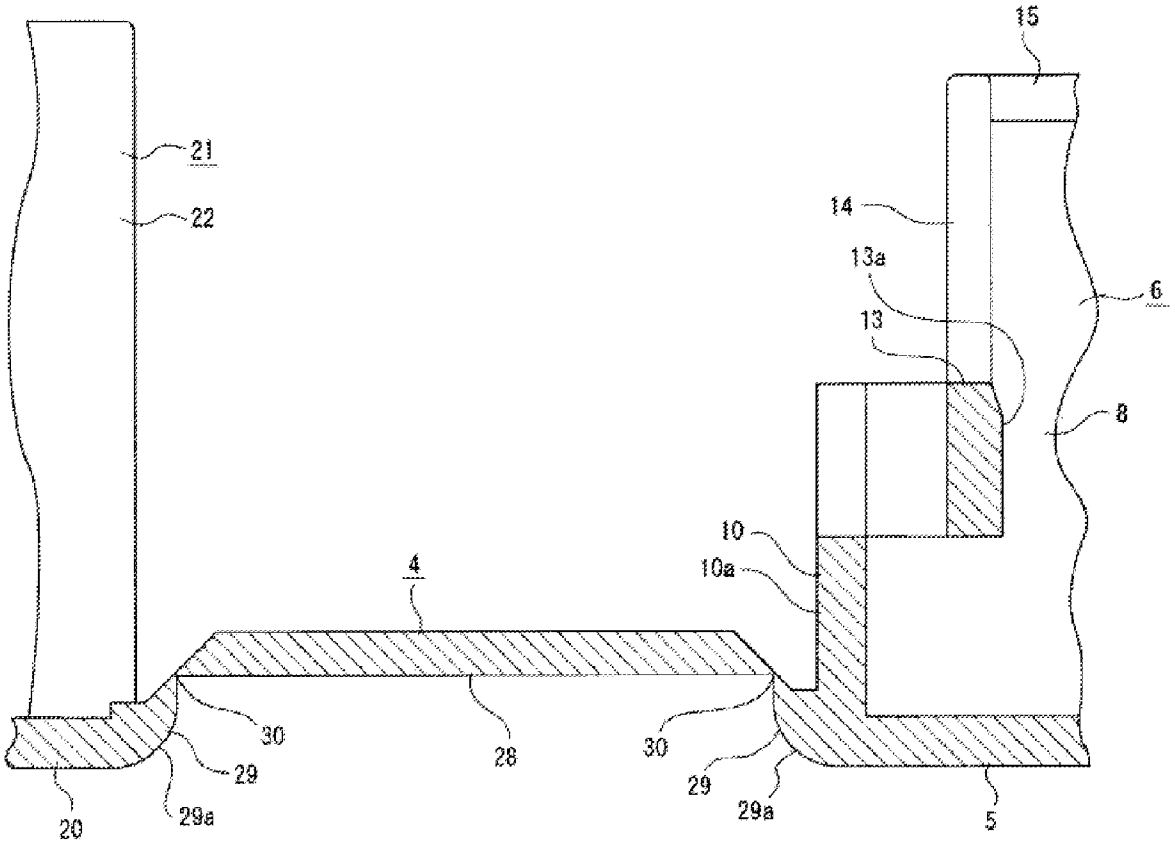
FIG. 8 is an enlarged cross-sectional view mainly showing a rear plate section.

The rear plate section 4 is formed in a substantially longitudinal direction elongated forward and rearward, and both end sections in a short side direction (the leftward and rightward directions) are connected to the base plate section 5 of the case section 2 and the closed surface section 20 of the lid section 3 (see FIGS. 4 and 8).

In the rear plate section 4, a portion excluding both end sections in the short side direction is formed as a flat plate section 28, and both end sections in the short side direction are formed as coupling sections 29 and 29.

Shallow insertion concave sections 28*a* and 28*a* extending in the short side direction are formed both of front and rear end sections of the inner surface of the flat plate section 28. Reinforcement protrusions 28*b* and 28*b* slightly protruding outward are formed at both of front and rear end sections of the outer surface of the flat plate section 28 (see FIG. 3). The flat plate section 28 has a portion, at which the reinforcement protrusions 28*b* and 28*b* are formed, having a thickness slightly larger than the other portions.

The coupling sections 29 and 29 are connected to one end section of the base plate section 5 and one end section of the closed surface section 20 to extend in directions perpendicular to the base plate section 5 and the closed surface section 20 (see FIG. 8). Outer surfaces of the coupling sections 29 and 29 are formed as curved surface sections 29*a* and 29*a* having an arc-shaped surface.

Since the coupling sections 29 and 29 protrude in the directions perpendicular to the base plate section 5 and the closed surface section 20, the flat plate section 28 of the rear plate section 4 is not disposed on the same plane as the base plate section 5 and the closed surface section 20 but disposed at positions displaced from the base plate section 5 and the closed surface section 20.

In the rear plate section 4, the flat plate section 28 and the coupling sections 29 and 29 are coupled by thin hinges 30 and 30. Accordingly, the thin hinges 30 and 30 are disposed at positions around both ends in the short side direction of the rear plate section 4, the one thin hinge 30 is formed at a position deviated in parallel with respect to a continuous portion (a ridgeline) between the rear plate section 4 and the coupling section 29 connected to one end section of the base plate section 5 of the case section 2, and the other thin hinge 30 is formed at a position deviated in parallel with respect to a continuous portion (a ridgeline) between the rear plate section 4 and the coupling section 29 connected to one end section of the closed surface section 20 of the lid section 3. Thus, the thin hinges 30 and 30 are not in the same plane as that of the base plate section 5 or the closed surface section 20 in the open state (see FIG. 8). In addition, the thin hinges 30 and 30 may not be formed at positions deviated with respect to the continuous portion but may be deviated in parallel.

Figure 9:
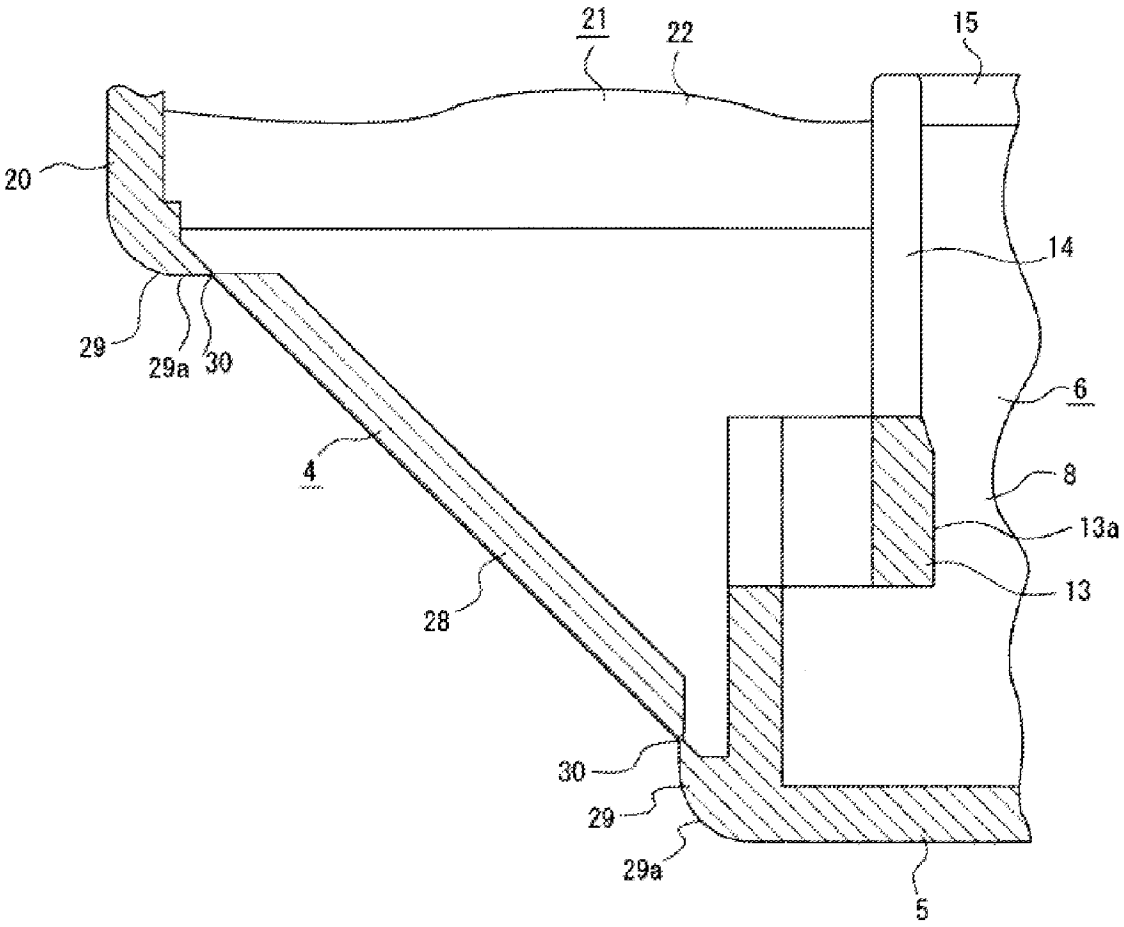
FIG. 9 is an enlarged cross-sectional view showing a state in which the respective parts are pivoted using a thin hinge as a fulcrum.

In the rear plate section 4, the flat plate section 28 and the coupling sections 29 and 29 are relatively pivotable using the thin hinges 30 and 30 as a fulcrum (see FIG. 9).

Cutout sections 4*a*, 4*a* . . . opened forward or rearward are formed at both of front and rear end sections of the rear plate section 4 on extension lines of the thin hinges 30 and 30 (see FIGS. 4 and 5).

[Receiving Operation with Respect to Cartridge Receiving Case of Cartridge]

Next, the receiving operation of the cartridge 50 with respect to the cartridge receiving case 1 will be described (see FIGS. 10 to 15).

Figure 10:
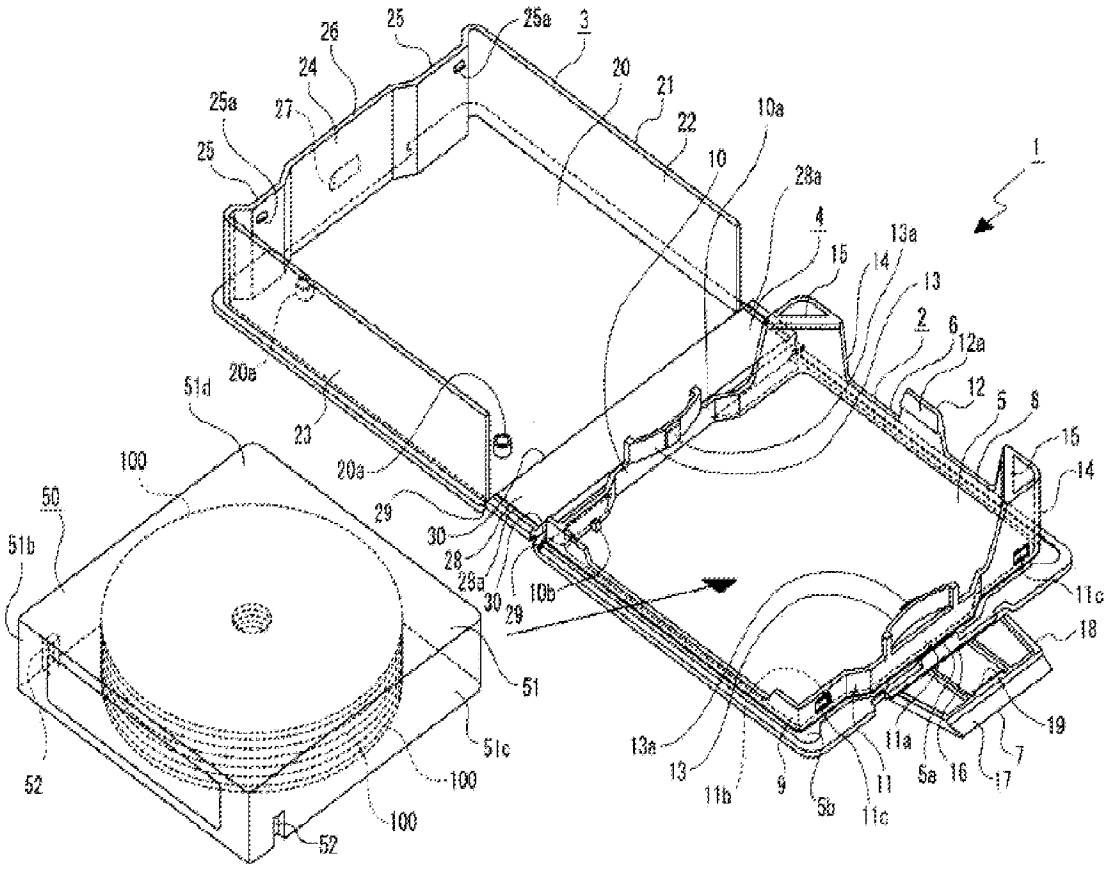
FIG. 10 is a perspective view showing a receiving operation of the cartridge and showing a state before the cartridge is inserted into the case section with FIGS. 11 to 17.

First, for example, the cartridge receiving case 1 is disposed on a placing surface of a frame or the like or opened in a state gripped by a hand (see FIG. 10). In the open state, the case section 2, the rear plate section 4 and the lid section 3 are sequentially disposed in parallel in the leftward and rightward directions.

Figure 11:
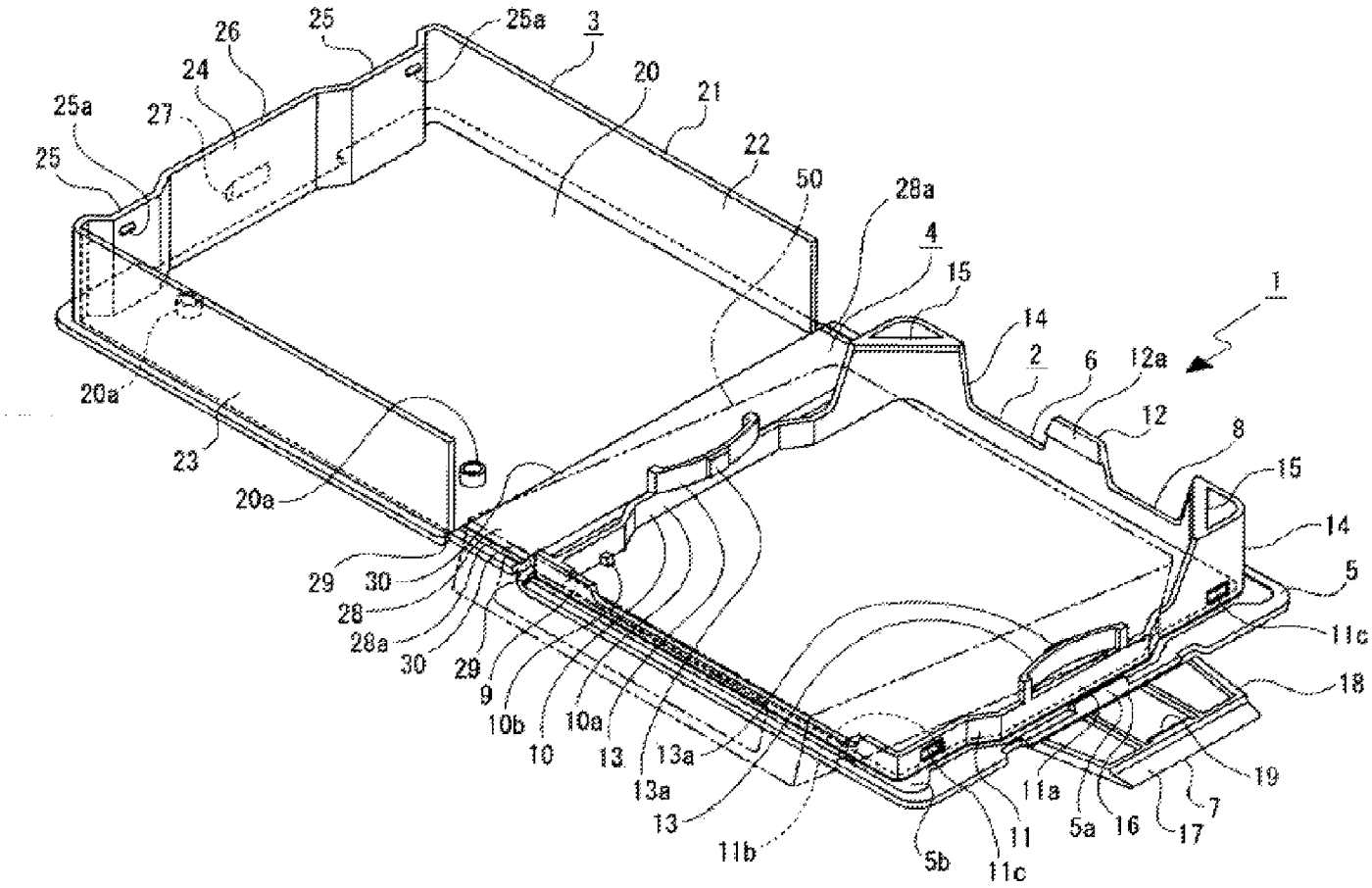
FIG. 11 is a perspective view showing a state in which the cartridge is being inserted into the case section.
Figure 12:
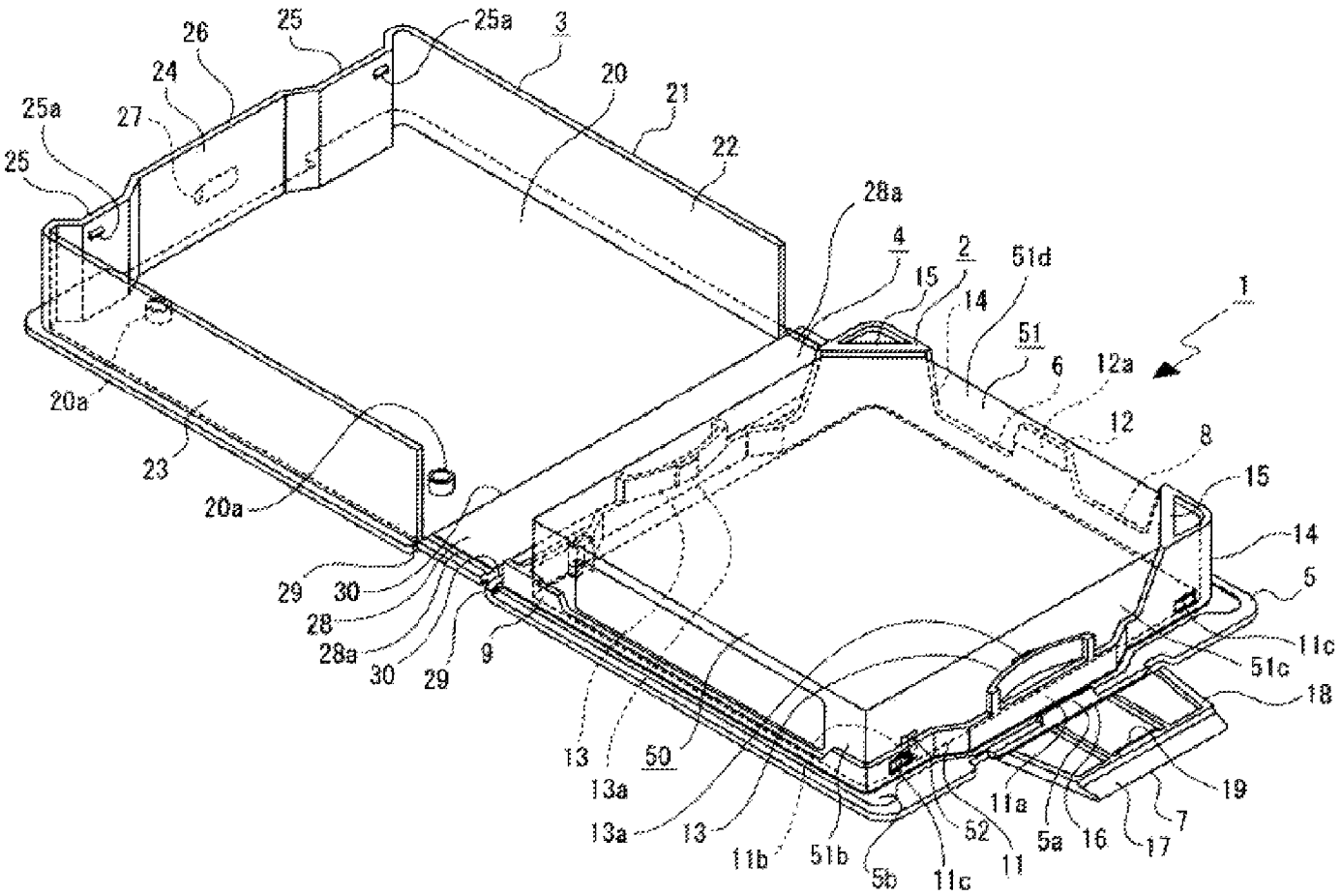
FIG. 12 is a perspective view showing a state in which the cartridge is inserted and disposed in the case section.

Next, in a state in which the cartridge receiving case 1 is open, the cartridge 50 is inserted and disposed in the case section 2 from slightly over a rear side of the case section 2 (see FIGS. 11 and 12). Here, it is determined that the misinsertion prevention protrusions 10*b* and 11*b* formed at the case section 2 are inserted into the grip sections 52 and 52 formed at the cartridge 50, and the cartridge 50 is inserted into the case section 2 in a proper direction.

In addition, upon insertion of the cartridge 50 into the case section 2, when the misinsertion prevention protrusions 10*b* and 11*b* are inserted into the grip sections 52 and 52, it is determined that the cartridge 50 is inserted into the case section 2 in an improper direction, and as a direction of the cartridge 50 is changed and the cartridge 50 is inserted again, the cartridge 50 can be disposed in the case section 2 in a proper direction.

Figure 13:
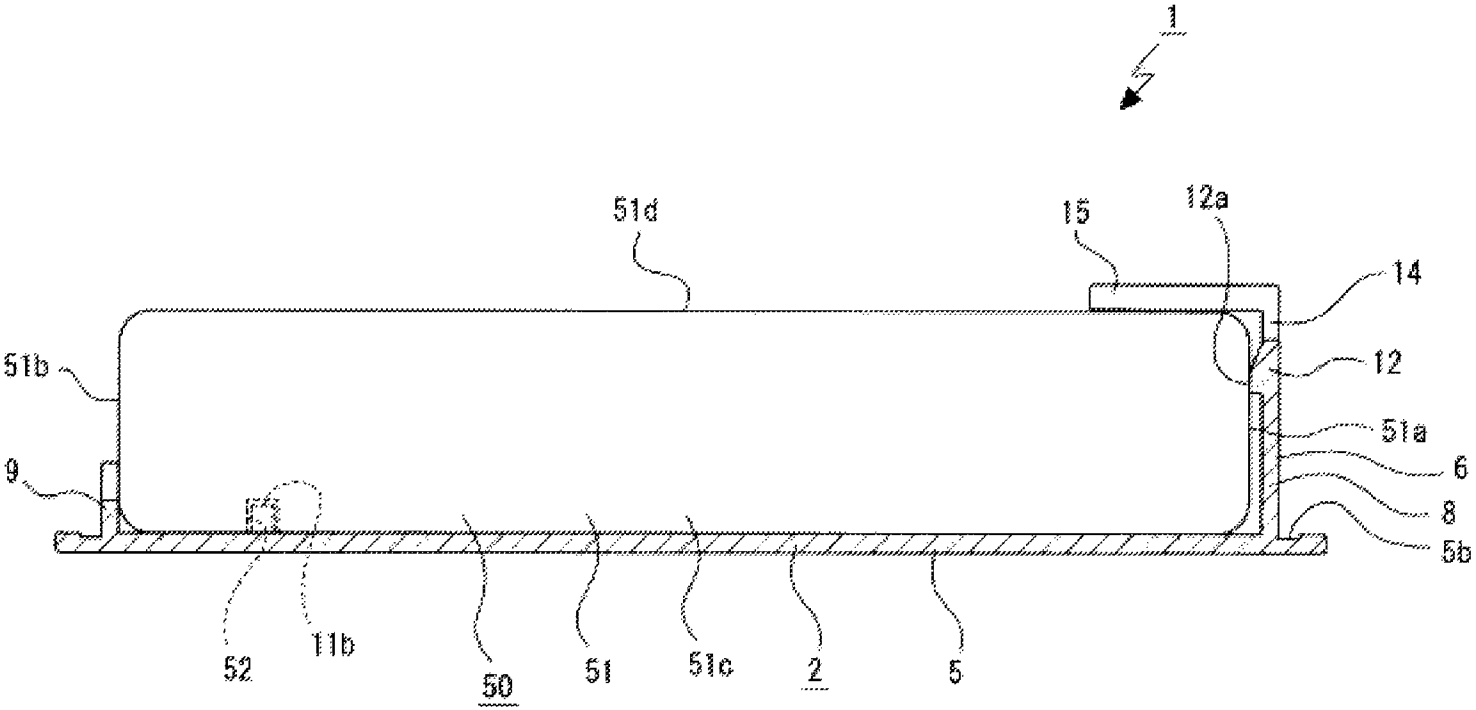
FIG. 13 is a cross-sectional view showing a state in which the cartridge disposed in the case section is pressed by a first elastic deformation section.

In a state in which the cartridge 50 is disposed in the case section 2, as described above, since the distance L1 between the receiving section 12*a* and the rear sidewall section 9 of the first elastic deformation section 12 is slightly smaller than the width H1 in the forward and rearward directions of the case body 51, the first elastic deformation section 12 is elastically deformed so that the receiving section 12*a* is pressed against a front surface 51*a* of the case body 51, and a rear surface 51*b* of the case body 51 is pressed against the rear sidewall section 9 of the case section 2 (see FIG. 13).

Accordingly, the cartridge 50 is disposed in the case section 2 in the forward and rearward directions in a stable state without shaking, displacement of the cartridge 50 in the cartridge receiving case 1 can be suppressed, the vibrations or shocks are unlikely to be applied from the cartridge 50 to the standing wall section 6 of the case section 2, and the damage or destruction on the cartridge receiving case 1 can be prevented.

Figure 14:
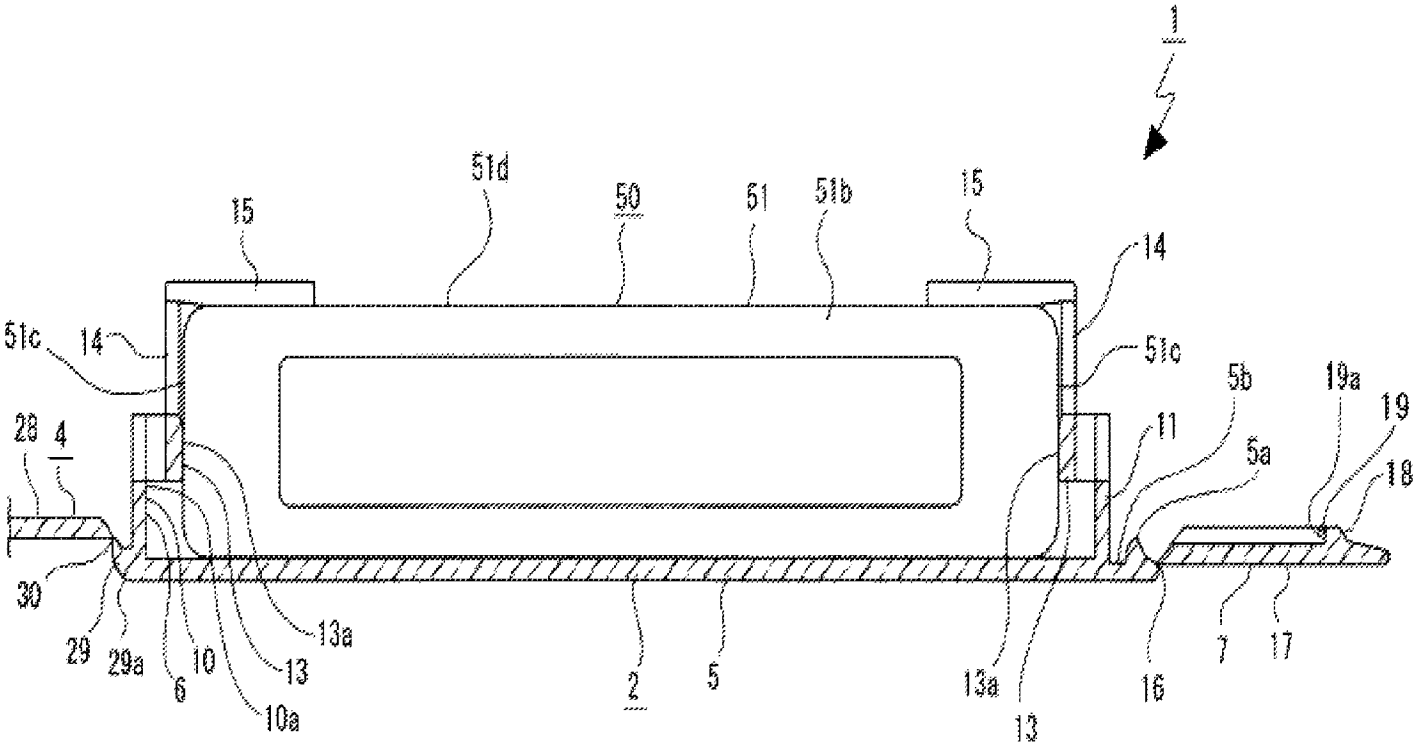
FIG. 14 is a cross-sectional view showing a state in which the cartridge disposed in the case section is pressed by a second elastic deformation section.

In addition, in a state in which the cartridge 50 is disposed in the case section 2, as described above, since the distance L2 between the receiving sections 13*a* and 13*a* of the second elastic deformation sections 13 and 13 is slightly smaller than the width H2 in the leftward and rightward directions of the case body 51, the second elastic deformation sections 13 and 13 are elastically deformed so that the receiving sections 13*a* and 13*a* are pressed against side surfaces 51*c* and 51*c* of the case body 51 (see FIG. 14).

Accordingly, the cartridge 50 can be disposed in the case section 2 in the leftward and rightward directions in a stable state without shaking, displacement of the cartridge 50 in the cartridge receiving case 1 can be suppressed, the vibrations or shocks are unlikely to be applied from the cartridge 50 to the standing wall section 6 of the case section 2, and the damage or destruction to the cartridge receiving case 1 can be prevented.

In addition, since the cartridge 50 is pressed from the forward and rearward directions by the first elastic deformation section 12 and pressed from the leftward and rightward directions by the second elastic deformation sections 13 and 13, the cartridge 50 can be disposed in the case section 2 in the forward and rearward directions and the leftward and rightward directions in a more stable state without shaking. Accordingly, displacement of the cartridge 50 in the cartridge receiving case 1 can be suppressed, the vibrations or shocks are unlikely to be applied from the cartridge 50 to the standing wall section 6 of the case section 2, and the damage or destruction to the cartridge receiving case 1 can be prevented.

Further, in a state in which the cartridge 50 is disposed in the case section 2, in the cartridge 50, both of left and right end sections of a front end section of an upper surface 51*d* are pressed from an upper side by the pressing surface sections 15 and 15.

Accordingly, since the cartridge 50 is pressed against the case section 2 in the upward and downward directions, the cartridge 50 can be disposed in the case section 2 in a stable state, displacement of the cartridge 50 in the cartridge receiving case 1 can be suppressed, and the damage or destruction to the cartridge receiving case 1 can be prevented.

Figure 15:
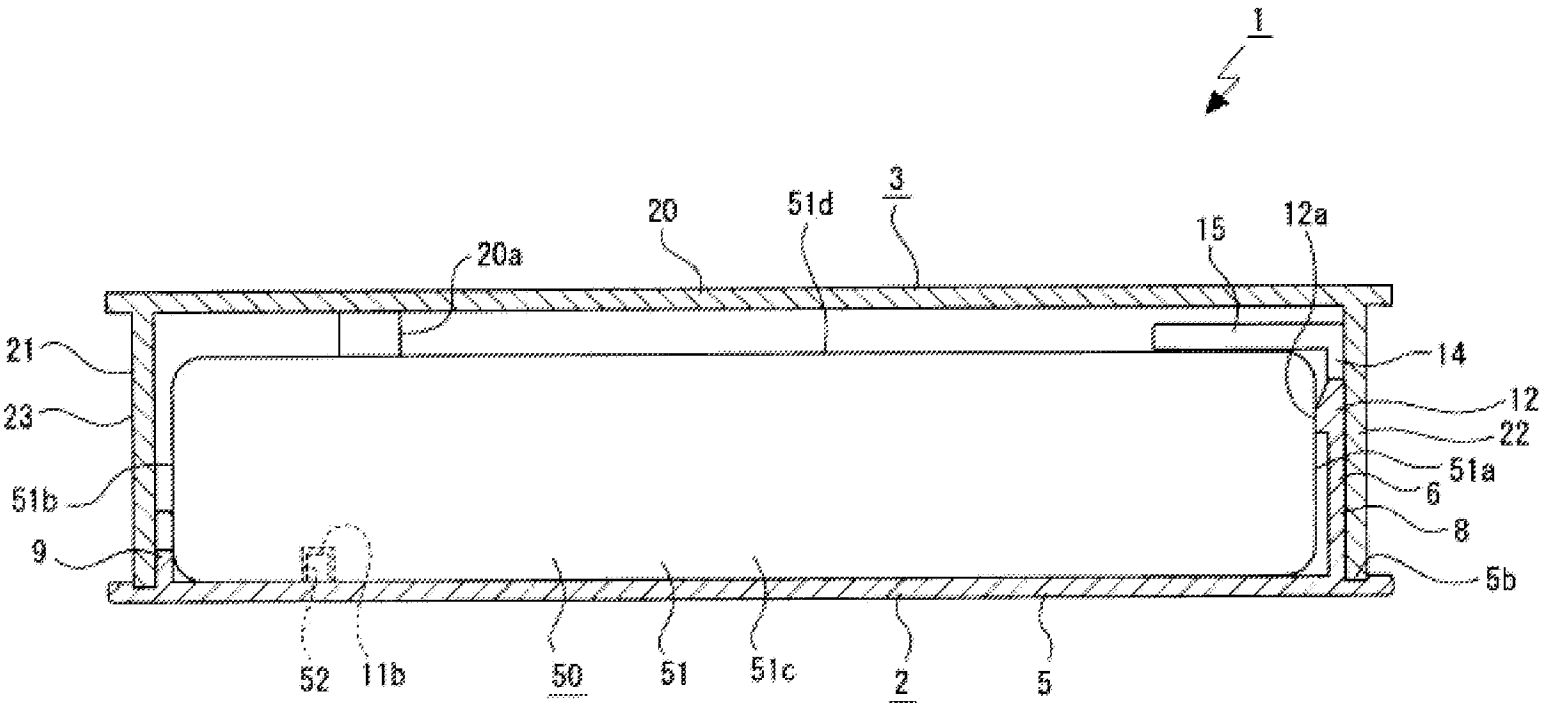
FIG. 15 is a cross-sectional view showing a state in which the cartridge disposed in the case section is pressed by the pressing section closed by the lid section.
Figure 16:
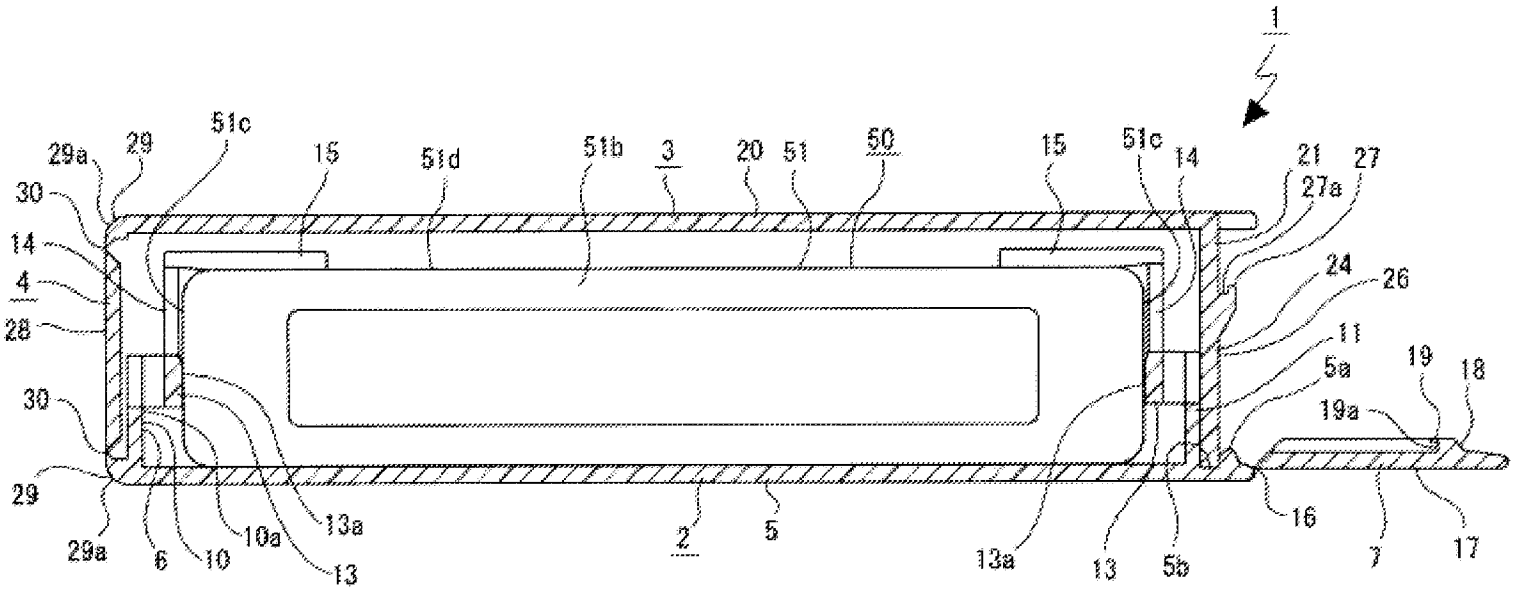
FIG. 16 is a cross-sectional view showing a state in which the cartridge disposed in the case section is closed by the lid section and the lid section is locked.

Next, in a state in which the cartridge 50 is disposed in the case section 2 as described above, as the rear plate section 4 is pivoted with respect to the case section 2 using the one thin hinge 30 as a fulcrum and the lid section 3 is pivoted with respect to the rear plate section 4 using the other thin hinge 30 as a fulcrum, the cartridge 50 is closed by the lid section 3 (see FIGS. 15 and 16).

In a state in which the cartridge 50 is closed by the lid section 3, a tip section of the enclosing wall section 21 of the lid section 3 is inserted into the insertion concave section 5*b* formed in an outer circumferential section of the case section 2 and the insertion concave sections 28*a* and 28*a* formed in the rear plate section 4. Here, a portion of the tip section of the enclosing wall section 21 is inserted and fitted between the swelling section 11*a* of the right sidewall section 11 and the rib section 5*a* of the base plate section 5 (see FIG. 16).

Accordingly, since an appropriate closed state of the lid section 3 with respect to the case section 2 is secured and the side surface section 24 of the lid section 3 comes in contact with the right sidewall section 11 of the case section 2 in the thickness direction, stiffness of the cartridge receiving case 1 can be increased, and deformation by the shock can be suppressed to improve the shock resistance when the shock is applied to the cartridge receiving case 1.

In addition, in a state in which the cartridge 50 is closed by the lid section 3, the locking protrusions 25*a* and 25*a* formed at the side surface section 24 of the lid section 3 are locked to the locking concave sections 11*c* and 11*c* formed at the right sidewall section 11 of the case section 2. Simultaneously, in the cartridge 50, portions around the rear ends of the upper surface 51*d* are pressed by the pressing protrusions 20*a* and 20*a* of the lid section 3 from an upper side.

Accordingly, since the cartridge 50 is pressed against the case section 2 in the upward and downward directions, the cartridge 50 can be disposed in the case section 2 in a stable state, displacement of the cartridge 50 in the cartridge receiving case 1 can be suppressed, and the damage or destruction to the cartridge receiving case 1 can be prevented.

Figure 17:
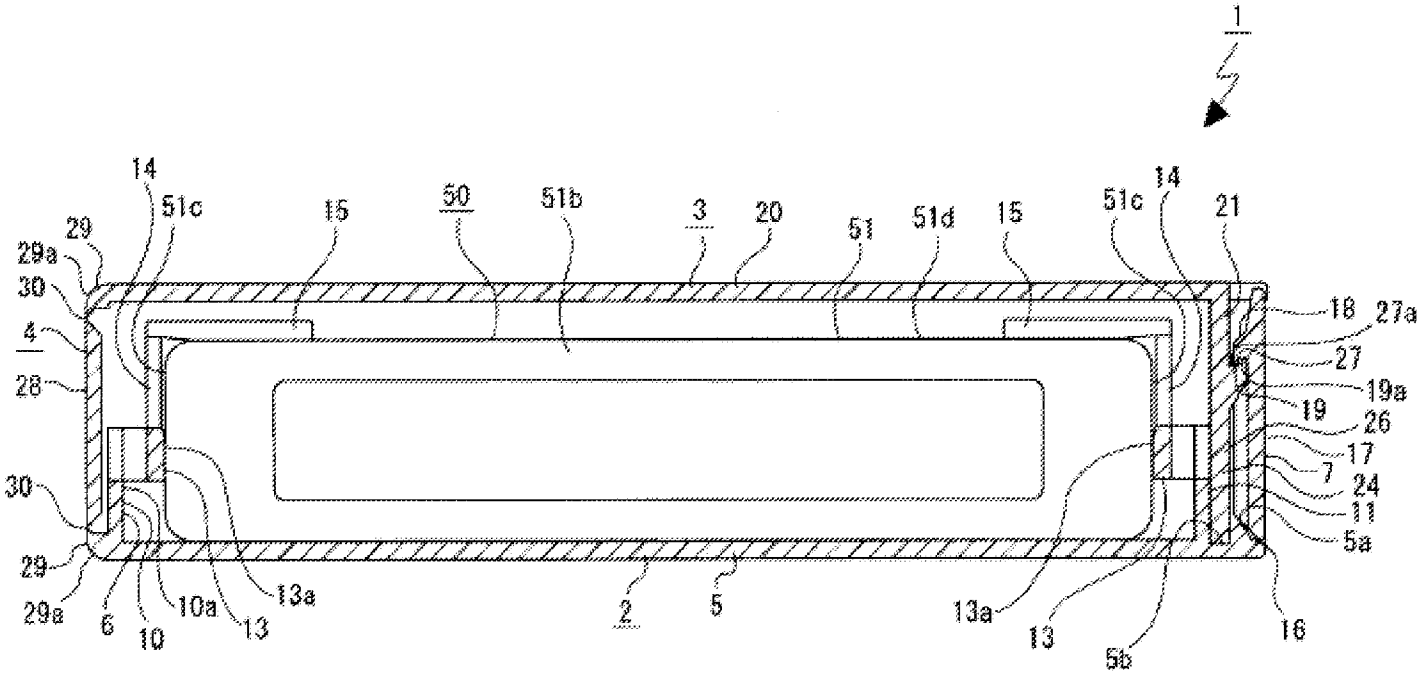
FIG. 17 is a cross-sectional view showing a state in which the lid section is locked to the case section by the lock piece section.

Finally, as the lock piece section 7 is pivoted with respect to the base plate section 5 using the hinge section 16 as a fulcrum, the engaging protrusion 19 of the lock piece section 7 is engaged with the engaging concave section 27*a* of the lid section 3 and the lid section 3 is locked to the case section 2 (see FIG. 17).

In the above-mentioned cartridge receiving case 1, since the lid section 3 is locked to the case section 2 by the lock piece section 7, the lid section 3 is not easily opened by a dropping shock or the like, and the shock resistance of the cartridge receiving case 1 can be improved.

In a state in which the lid section 3 is locked to the case section 2, the engaging protrusion 19 of the lock piece section 7 is engaged with the engaging concave section 27*a* of the lid section 3 and the engaging protrusion 27 of the lid section 3 is engaged with the engaging concave section 19*a* of the lock piece section 7.

Extraction of the cartridge 50 received in the cartridge receiving case 1 to the outside pivots the lock piece section 7 using the hinge section 16 as a fulcrum to release engagement of the engaging protrusion 19 with respect to the engaging concave section 27*a*, then the lid section 3 and the rear plate section 4 are pivoted using the thin hinges 30 and 30 as a fulcrum to open the cartridge 50, and the cartridge 50 can be extracted from the case section 2 to slightly above a rear side.

[Other Examples of Cartridge Receiving Case]

Figure 18:
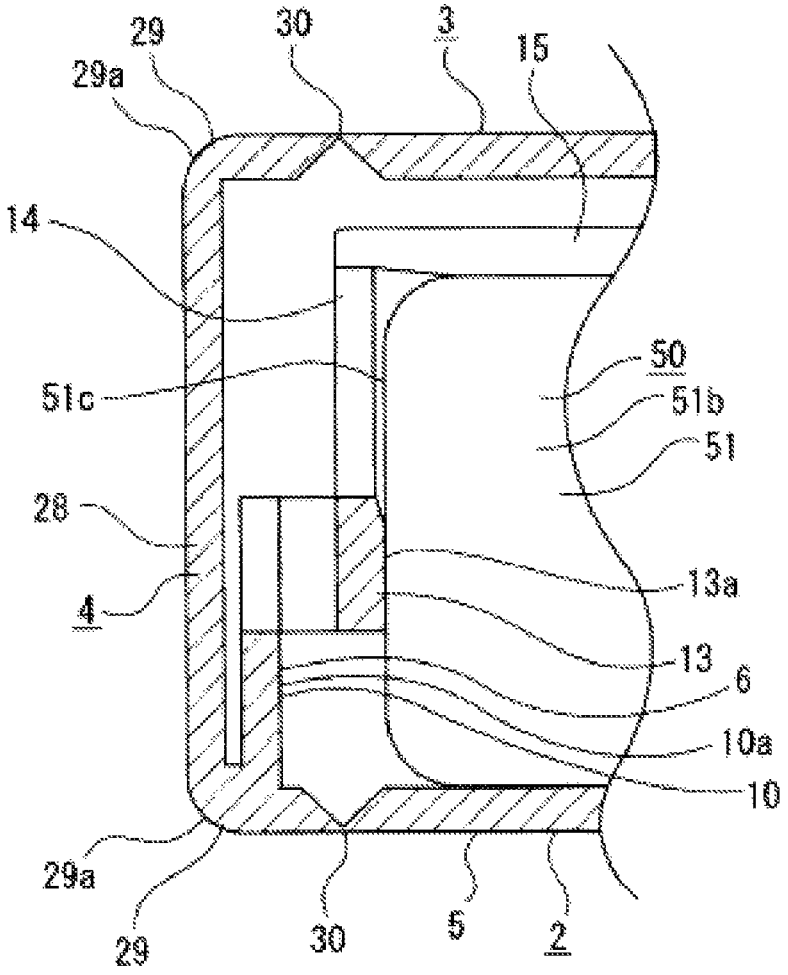
FIG. 18 is an enlarged cross-sectional view showing an example in which the thin hinges are formed at the case section and the lid section.

While the above description is of an example in which the thin hinges 30 and 30 are formed at the rear plate section 4, the thin hinges 30 and 30 may be formed at end sections of the case section 2 and the lid section 3 adjacent to the rear plate section 4 (see FIG. 18). Accordingly, the one thin hinge 30 is formed at a position deviated with respect to the continuous portion (the ridgeline) between the rear plate section 4 and the base plate section 5 of the case section 2, and the other thin hinge 30 is formed at a position deviated with respect to the continuous portion (the ridgeline) between the rear plate section 4 and the closed surface section 20 of the lid section 3. In addition, the thin hinges 30 and 30 may not be formed at positions deviated with respect to the continuous portion but may be disposed in parallel.

In addition, in the cartridge receiving case 1, the one thin hinge 30 may be formed at the rear plate section 4, and the other thin hinge 30 may be formed at the case section 2 or the lid section 3.

Figure 19:
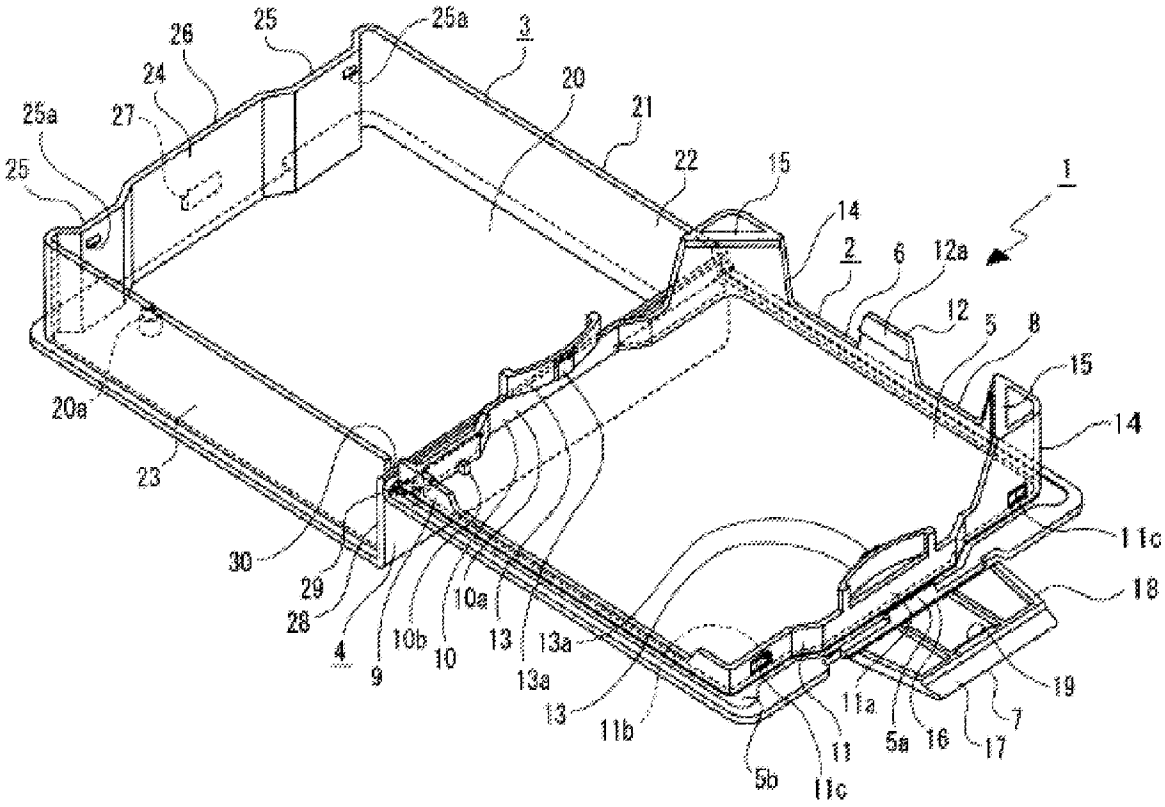
FIG. 19 is a perspective view showing an example of the cartridge receiving case having the rear plate section coupled to the lid section.

Further, in the cartridge receiving case 1, the lid section 3 and the rear plate section 4 are coupled, i.e., the enclosing wall section 21 and the rear plate section 4 are coupled to be integrally formed (see FIG. 19).

In this case, the one thin hinge 30 may be formed at the rear plate section 4 or the case section 2, and the thin hinge 30 is disposed at a position around one end of the rear plate section 4 near the case section 2 or a position around one end of the case section 2 near the rear plate section 4.

In addition, while the above description is of an example in which the lock piece section 7 having the engaging protrusion 19 is formed at the case section 2 and the engaging concave section 27*a* engaged with the engaging protrusion 19 is formed at the lid section 3, the lock piece section having the engaging protrusion may be formed at the lid section and the engaging concave section engaged with the engaging protrusion of the lock piece section may be formed at the case section.

[Shock Resistance of Cartridge Receiving Case]

Figure 20:
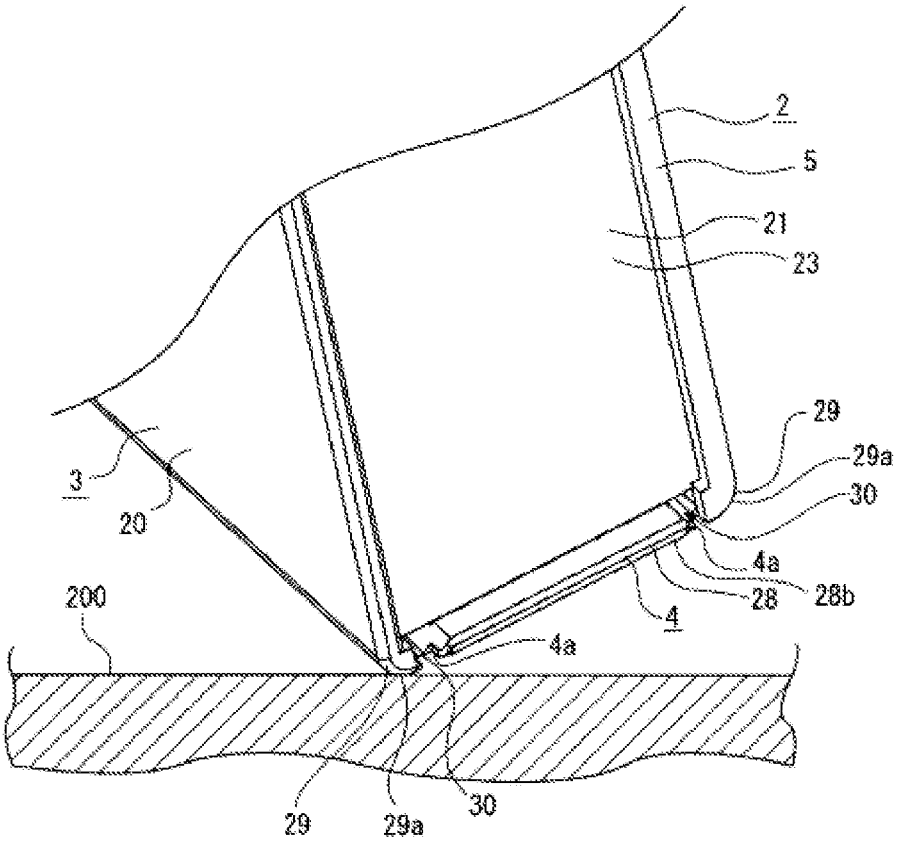
FIG. 20 is a perspective view showing a state in which the cartridge receiving case is dropped and a corner collides with a the droppage surface.

In the cartridge receiving case 1 configured as described above, while the shock may be applied to the cartridge receiving case 1 due to droppage or the like, when the cartridge receiving case 1 is dropped, a corner which is a continuous portion between the case section 2 and the rear plate section 4, or a corner which is a continuous portion between the lid section 3 and the rear plate section 4 is likely to collide with a droppage surface 200 (see FIG. 20).

Accordingly, since the thin hinges 30 and 30 are unlikely to collide with the droppage surface 200 and the shock is unlikely to be applied to the thin hinges 30 and 30, the damage or rupture of the thin hinges 30 and 30 is unlikely to occur, and the shock resistance can be improved.

In addition, since the reinforcement protrusions 28*b* and 28*b* are formed at both of front and rear end sections in the outer surface of the rear plate section 4 of the cartridge receiving case 1, the thin hinges 30 and 30 are unlikely to collide with the droppage surface 200, and generation of the damage or rupture on the thin hinges 30 and 30 can be suppressed.

Figure 21:
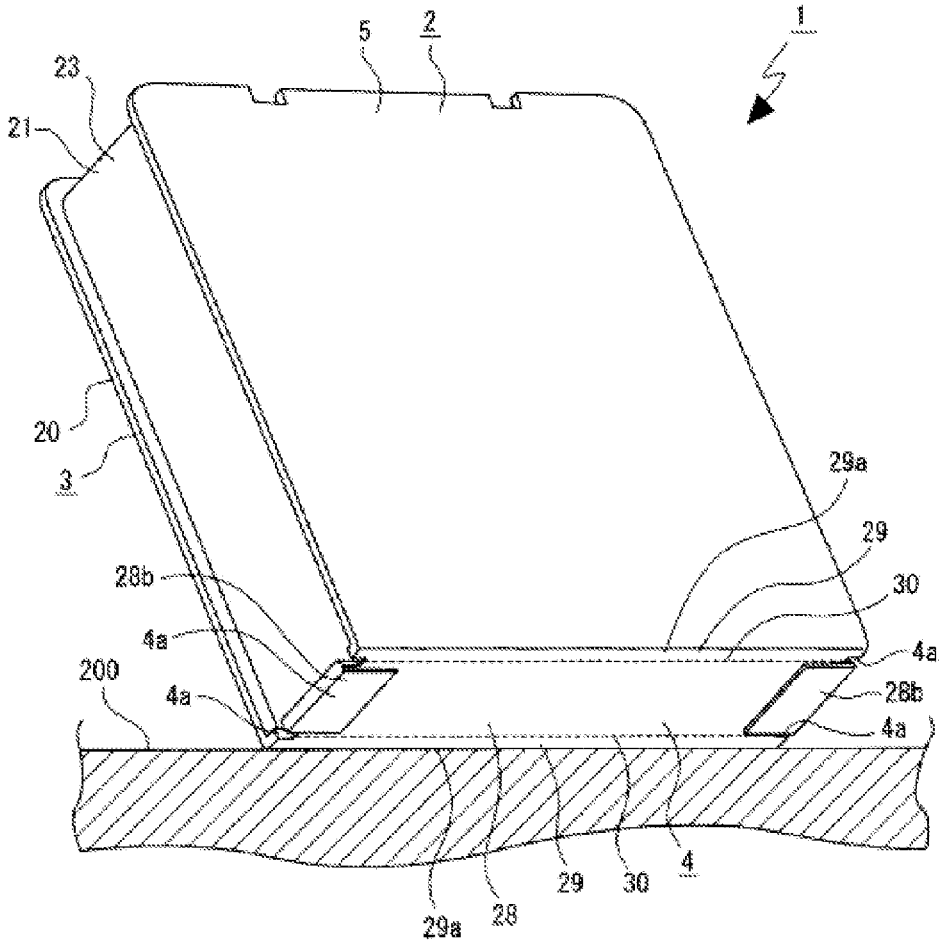
FIG. 21 is a perspective view showing a state in which the cartridge receiving case is dropped and one end of the rear plate section collides with the droppage surface.

Further, the cutout sections 4*a*, 4*a* . . . are formed at the cartridge receiving case 1 on extension lines of the thin hinges 30 and 30 of the rear plate section 4. Accordingly, even when both of front and rear ends (a ridgeline) of the rear plate section 4 collide with the droppage surface 200 upon droppage of the cartridge receiving case 1 (see FIG. 21), the thin hinges 30 and 30 do not collide with the droppage surface 200, and the damage or rupture of the thin hinges 30 and 30 can be suppressed from occurring.

In addition, as described above, while the thin hinges 30 and 30 may be formed at either of the case section 2, the lid section 3 or the rear plate section 4, the rear plate section 4 does not come in contact with the placing surface of the frame or the like in either of the open state and the closed state.

Accordingly, when the thin hinges 30 and 30 are formed at the rear plate section 4, the thin hinges 30 and 30 do not come in contact with the placing surface, the shock is unlikely to be applied to the thin hinges 30 and 30 to that extent, the damage or rupture to the thin hinges 30 and 30 does not easily occur, and in particular, the shock resistance can be improved.

[Present Technology]

Additionally, the present technology may also be configured as below.

(1)

A cartridge receiving case including:

a case section in which a cartridge is inserted and disposed;

a lid section configured to be opened and closed with respect to the case section and to cover the cartridge disposed in the case section upon closing; and a rear plate section configured to connect the case section and the lid section, wherein the case section, the lid section and the rear plate section are integrally formed, wherein a pair of parallel thin hinges are formed as curved portions when the opening and closing operations of the lid section with respect to the case section are performed, wherein one of the thin hinges is formed at a position deviated with respect to a continuous portion between the rear plate section and the case section, and wherein the other thin hinge is formed at a position deviated with respect to a continuous portion between the rear plate section and the lid section.

(2)

The cartridge receiving case according to (1), wherein the pair of thin hinges are formed at the rear plate section.

(3)

The cartridge receiving case according to (2), wherein reinforcement protrusions protruding outward are formed at both end sections of an outer surface of the rear plate section in directions in which the pair of thin hinges extend.

(4)

The cartridge receiving case according to (2) or (3), wherein cutout sections disposed on the extension lines of the thin hinges are formed at both end sections of the rear plate section in directions in which the pair of thin hinges extend.

(5)

The cartridge receiving case according to any one of (1) to (4), wherein a base plate section, a standing wall section protruding from at least a portion around an outer circumference of the base plate section, and a rib section protruding from a portion of an outer circumferential section of the base plate section in a same direction as the standing wall section are formed at the case section, wherein a closed surface section disposed opposite to the base plate section upon the closing and an enclosing wall section protruding from at least a portion of an outer circumferential section of the closed surface section are formed at the lid section, and wherein the enclosing wall section is fitted between the standing wall section and the rib section upon the closing.

(6)

The cartridge receiving case according to any one of (1) to (5), wherein a lock piece section having an engaging protrusion or an engaging concave section is formed at one of the case section and the lid section, and wherein an engaging concave section or an engaging protrusion with which the engaging protrusion or the engaging concave section is engaged upon the closing is formed at the other of the case section and the lid section.

(7)

The cartridge receiving case according to any one of (1) to (6), wherein an elastic deformation section configured to press the cartridge in an elastically deformed state is formed at the case section.

(8)

The cartridge receiving case according to (1), wherein at least three elastic deformation sections are formed, and wherein surfaces of an outer circumferential surface of the cartridge in different directions are configured to be pressed by the respective elastic deformation sections.

(9)

The cartridge receiving case according to any one of (1) to (8), wherein a base plate section, a standing wall section protruding from at least a portion around an outer circumference of the base plate section, and a pressing surface section connected to the standing wall section and opposite to the base plate section are formed at the case section, and wherein the cartridge is configured to be pressed toward the base plate section by the pressing surface section.

(10)

The cartridge receiving case according to any one of (1) to (9), wherein a base plate section is formed at the case section, wherein a closed surface section disposed opposite to the base plate section upon the closing is formed at the lid section, and wherein a pressing protrusion configured to press the cartridge upon the closing is formed at the closed surface section.

It should be understood by those skilled in the art that various modifications, combinations, sub-combinations and alterations may occur depending on design requirements and other factors insofar as they are within the scope of the appended claims or the equivalents thereof.

What is claimed is:

1. A cartridge receiving case comprising:

a case section in which a cartridge is inserted and disposed;

a lid section configured to be opened and closed with respect to the case section and to cover the cartridge disposed in the case section upon closing;

a rear plate section configured to connect the case section and the lid section, wherein the case section, the lid section, and the rear plate section are integrally formed; and a pair of parallel thin hinges are formed adjacent to curved portions of the case section and the lid section that form respective coupling sections of the case section and the lid section when the lid section is opened and closed with respect to the case section, wherein one of the thin hinges of the pair of parallel thin hinges is formed at a position deviated with respect to a continuous portion between the rear plate section and a first coupling section connected to the case section, wherein the other thin hinge of the pair of parallel thin hinges is formed at a position deviated with respect to a continuous portion between the rear plate section and of a second coupling section connected to the lid section, wherein a base plate section, a standing wall section protruding from at least a portion around an outer circumference of the base plate section, and a pressing surface section connected to the standing wall section and opposite to the base plate section are formed at the case section, and wherein the cartridge is configured to be pressed toward the base plate section by the pressing surface section.

2. The cartridge receiving case according to claim 1, wherein the pair of parallel thin hinges are formed at the rear plate section.

3. The cartridge receiving case according to claim 2, wherein reinforcement protrusions protruding outward are formed at both end sections of an outer surface of the rear plate section in directions in which the pair of parallel thin hinges extend.

4. The cartridge receiving case according to claim 2, wherein cutout sections disposed on extension lines of the pair of parallel thin hinges are formed at both end sections of the rear plate section in directions in which the pair of parallel thin hinges extend.

5. The cartridge receiving case according to claim 1, wherein the base plate section, the standing wall section protruding from at least the portion around the outer circumference of the base plate section, and a rib section protruding from a portion of an outer circumferential section of the base plate section in a same direction as the standing wall section are formed at the case section, wherein a closed surface section disposed opposite to the base plate section upon the closing and an enclosing wall section protruding from at least a portion of an outer circumferential section of the closed surface section are formed at the lid section, and wherein the enclosing wall section is fitted between the standing wall section and the rib section upon the closing.

6. The cartridge receiving case according to claim 1, wherein a lock piece section having an engaging protrusion or an engaging concave section is formed at one of the case section and the lid section, and wherein an engaging concave section or an engaging protrusion with which the engaging protrusion or the engaging concave section is engaged upon the closing is formed at the other of the case section and the lid section.

7. The cartridge receiving case according to claim 1, wherein an elastic deformation section configured to press the cartridge in an elastically deformed state is formed at the case section.

8. The cartridge receiving case according to claim 7, wherein at least three elastic deformation sections are formed, and wherein surfaces of an outer circumferential surface of the cartridge in different directions are configured to be pressed by the respective elastic deformation sections.

9. The cartridge receiving case according to claim 1, wherein a closed surface section disposed opposite to the base plate section upon the closing is formed at the lid section, and wherein a pressing protrusion configured to press the cartridge upon the closing is formed at the closed surface section.

10. A cartridge receiving case comprising:

a case section in which a cartridge is inserted and disposed;

a lid section configured to be opened and closed with respect to the case section and to cover the cartridge disposed in the case section upon closing;

a rear plate section configured to connect the case section and the lid section, wherein the case section, the lid section, and the rear plate section are integrally formed; and a pair of parallel thin hinges are formed adjacent to curved portions of the case section and the lid section that form respective coupling sections of the case section and the lid section when the lid section is opened and closed with respect to the case section, wherein one of the thin hinges of the pair of parallel thin hinges is formed at a position deviated with respect to a continuous portion between the rear plate section and a first coupling section connected to the case section, wherein the other thin hinge of the pair of parallel thin hinges is formed at a position deviated with respect to a continuous portion between the rear plate section and of a second coupling section connected to the lid section, wherein a base plate section is formed at the case section, wherein a closed surface section disposed opposite to the base plate section upon the closing is formed at the lid section, and wherein a pressing protrusion configured to press the cartridge upon the closing is formed at the closed surface section.

* * * * *